US008887839B2

(12) United States Patent
Vempati et al.

(10) Patent No.: US 8,887,839 B2
(45) Date of Patent: Nov. 18, 2014

(54) DRILL BIT FOR USE IN DRILLING SUBTERRANEAN FORMATIONS

(75) Inventors: Chaitanya K. Vempati, The Woodlands, TX (US); Jack Thomas Oldham, Conroe, TX (US); Edwin R Reek, Muscat (OM); Danielle M. Fuselier, Spring, TX (US); Suresh G. Patel, The Woodlands, TX (US); Robert Laing, Montgomery, TX (US)

(73) Assignee: Baker Hughes Incorporated, Houston, TX (US)

( * ) Notice: Subject to any disclaimer, the term of this patent is extended or adjusted under 35 U.S.C. 154(b) by 597 days.

(21) Appl. No.: 12/817,411

(22) Filed: Jun. 17, 2010

(65) Prior Publication Data

US 2010/0326742 A1 Dec. 30, 2010

Related U.S. Application Data

(60) Provisional application No. 61/220,464, filed on Jun. 25, 2009.

(51) Int. Cl.
*E21B 10/36* (2006.01)
*E21B 10/43* (2006.01)

(52) U.S. Cl.
CPC ..... *E21B 10/43* (2013.01)
USPC ..... 175/431; 175/426

(58) Field of Classification Search
USPC ..... 175/431, 426, 430, 432
See application file for complete search history.

(56) References Cited

U.S. PATENT DOCUMENTS

| | | | |
|---|---|---|---|
| 2,947,609 | A | 8/1960 | Strong |
| 4,128,136 | A | 12/1978 | Generoux |
| 4,186,628 | A | 2/1980 | Bonnice |
| 4,255,165 | A | 3/1981 | Dennis et al. |

(Continued)

FOREIGN PATENT DOCUMENTS

| | | | |
|---|---|---|---|
| EP | 0546725 | A1 | 6/1993 |
| EP | 0582484 | A1 | 2/1994 |

(Continued)

OTHER PUBLICATIONS

The International Search Report and the Written Opinion for International Application No. PCT/US2010/039794 received from the International Searching Authority (ISA/KR), dated Feb. 8, 2011, 6 pages.

(Continued)

*Primary Examiner* — Kenneth L Thompson
*Assistant Examiner* — Michael Wills, III
(74) *Attorney, Agent, or Firm* — TraskBritt

(57) ABSTRACT

A drill bit for drilling subterranean formations comprising a drill bit body including a group of primary cutting elements comprising a first primary cutting element and a second primary cutting element radially spaced apart from each other along a first radial axis. The drill bit body further including a group of backup cutting elements comprising a first backup cutting element in a secondary cutting position relative to the first primary cutting element and a second backup cutting element in secondary cutting positions relative to the second primary cutting element, wherein the first and second backup cutting elements are radially spaced apart from each other along a second radial axis different than the first radial axis and comprise a difference in cutting characteristic relative to each other of one of a backrake angle and a siderake angle.

20 Claims, 14 Drawing Sheets

(56) References Cited

U.S. PATENT DOCUMENTS 4,351,401 A 9/1982 Fielder
4,385,907 A 5/1983 Tomita et al.
4,471,845 A 9/1984 Jurgens
4,478,298 A 10/1984 Hake et al.
4,592,433 A 6/1986 Dennis
4,604,106 A 8/1986 Hall et al.
4,662,896 A 5/1987 Dennis
4,676,124 A 6/1987 Fischer
4,718,505 A 1/1988 Fuller
4,764,255 A 8/1988 Fischer et al.
4,797,138 A 1/1989 Komanduri
4,828,436 A 5/1989 Briese
4,850,523 A 7/1989 Slutz
4,861,350 A 8/1989 Phaal et al.
4,866,885 A 9/1989 Dodsworth
4,919,220 A 4/1990 Fuller et al.
4,932,484 A 6/1990 Warren et al.
4,987,800 A 1/1991 Gasan et al.
4,991,670 A 2/1991 Fuller et al.
4,993,888 A 2/1991 Briese
4,997,049 A 3/1991 Tank et al.
5,025,873 A 6/1991 Cerkovnik
5,028,177 A 7/1991 Meskin et al.
5,030,276 A 7/1991 Sung et al.
5,049,164 A 9/1991 Horton et al.
5,057,124 A 10/1991 Cerceau
5,116,568 A 5/1992 Sung et al.
5,119,714 A 6/1992 Scott et al.
5,147,001 A 9/1992 Chow et al.
5,154,245 A 10/1992 Waldenstrom et al.
5,159,857 A 11/1992 Jurewicz
5,173,090 A 12/1992 Scott et al.
5,199,832 A 4/1993 Meskin et al.
5,217,081 A 6/1993 Waldenstrom et al.
5,232,320 A 8/1993 Tank et al.
5,238,074 A 8/1993 Tibbitts et al.
5,248,317 A 9/1993 Tank et al.
5,264,283 A 11/1993 Waldenstrom et al.
5,273,125 A 12/1993 Jurewicz
5,282,513 A 2/1994 Jones
5,299,471 A 4/1994 Tank et al.
5,370,717 A 12/1994 Lloyd et al.
5,421,423 A 6/1995 Huffstutler
5,431,239 A 7/1995 Tibbitts et al.
5,433,778 A 7/1995 Sleight
5,435,403 A 7/1995 Tibbitts
5,437,343 A 8/1995 Cooley et al.
5,499,688 A 3/1996 Dennis
5,514,360 A 5/1996 Sleight et al.
5,531,281 A * 7/1996 Murdock ..... 175/431
5,535,838 A 7/1996 Kashavan et al.
5,549,171 A * 8/1996 Mensa-Wilmot et al. .... 175/431
5,551,522 A 9/1996 Keith et al.
5,582,261 A 12/1996 Keith et al.
5,651,421 A 7/1997 Newton et al.
5,667,028 A 9/1997 Truax et al.
5,706,906 A 1/1998 Jurewicz et al.
5,720,357 A 2/1998 Fuller et al.
5,722,497 A 3/1998 Gum et al.
5,740,874 A 4/1998 Matthias
5,755,299 A 5/1998 Langforn, Jr. et al.
5,776,550 A 7/1998 Disam et al.
5,816,346 A 10/1998 Beaton
5,871,060 A 2/1999 Jensen et al.
5,881,830 A 3/1999 Cooley
5,904,213 A 5/1999 Caraway et al.
5,906,245 A 5/1999 Tibbitts et al.
5,919,720 A 7/1999 Sleight et al.
5,924,501 A 7/1999 Tibbitts
5,947,609 A 9/1999 Lee
5,960,896 A 10/1999 Barr et al.
5,967,249 A 10/1999 Butcher
5,975,811 A 11/1999 Briese
5,979,571 A 11/1999 Scott et al.
5,979,578 A 11/1999 Packer
5,979,579 A 11/1999 Jurewicz
6,000,483 A 12/1999 Jurewicz et al.
6,003,623 A 12/1999 Miess
6,009,962 A 1/2000 Beaton
6,068,071 A 5/2000 Jurewicz
6,082,223 A 7/2000 Tibbitts
6,098,729 A 8/2000 Matthias
6,102,140 A 8/2000 Boyce et al.
6,123,161 A 9/2000 Taylor
6,132,676 A 10/2000 Holzer et al.
6,145,607 A 11/2000 Griffin et al.
6,148,938 A 11/2000 Beaton
6,164,394 A 12/2000 Mensa-Wilmot et al.
6,183,716 B1 2/2001 Sleight et al.
6,187,068 B1 2/2001 Frushour et al.
6,187,700 B1 2/2001 Merkel
6,189,634 B1 2/2001 Bertagnolli et al.
6,193,001 B1 2/2001 Eyre et al.
6,202,770 B1 3/2001 Jurewicz et al.
6,202,771 B1 3/2001 Scott et al.
6,216,805 B1 4/2001 Lays et al.
6,218,324 B1 4/2001 Goettler
6,220,375 B1 4/2001 Butcher et al.
6,230,828 B1 5/2001 Beuershausen et al.
6,258,743 B1 7/2001 Fleming et al.
6,283,233 B1 9/2001 Lamine et al.
6,315,066 B1 11/2001 Dennis
6,326,685 B1 12/2001 Jin et al.
6,401,844 B1 6/2002 Doster et al.
6,401,845 B1 6/2002 Fielder
6,403,511 B2 6/2002 Fleming et al.
6,412,580 B1 7/2002 Chaves
6,439,327 B1 8/2002 Griffin et al.
6,446,740 B2 9/2002 Eyre et al.
6,481,511 B2 11/2002 Matthias et al.
6,510,906 B1 1/2003 Richert et al.
6,521,174 B1 2/2003 Butcher et al.
6,612,383 B2 9/2003 Desai et al.
6,672,406 B2 1/2004 Beuershausen
6,739,417 B2 5/2004 Smith et al.
6,742,611 B1 6/2004 Illerhaus et al.
6,823,952 B1 11/2004 Mensa-Wilmot et al.
6,872,356 B2 3/2005 Butcher et al.
6,935,444 B2 8/2005 Lund et al.
7,070,011 B2 7/2006 Sherwood, Jr. et al.
7,105,235 B2 9/2006 Lo et al.
7,159,487 B2 1/2007 Mensa-Wilmot et al.
7,188,692 B2 3/2007 Lund et al.
7,237,628 B2 7/2007 Desai et al.
7,350,601 B2 4/2008 Belnap et al.
7,363,992 B2 4/2008 Stowe et al.
7,377,341 B2 5/2008 Middlemiss
7,395,882 B2 7/2008 Oldham et al.
7,462,003 B2 12/2008 Middlemiss
7,473,287 B2 1/2009 Belnap et al.
7,493,973 B2 2/2009 Keshavan et al.
7,594,553 B2 9/2009 Tank et al.
7,624,818 B2 12/2009 McClain et al.
7,757,793 B2 7/2010 Voronin et al.
2001/0031692 A1 10/2001 Fleming et al.
2003/0084894 A1 5/2003 Sung
2003/0218268 A1 11/2003 Morito et al.
2004/0007394 A1 1/2004 Griffin
2005/0077091 A1 4/2005 Butland et al.
2005/0100743 A1 5/2005 Hougham et al.
2005/0101133 A1 5/2005 Tzeng et al.
2005/0263328 A1 12/2005 Middlemiss
2006/0032677 A1 2/2006 Azar et al.
2006/0060390 A1 3/2006 Eyre
2006/0070771 A1 4/2006 McClain et al.
2006/0099895 A1 5/2006 Tank et al.
2006/0144621 A1 7/2006 Tank et al.
2006/0162969 A1 7/2006 Belnap et al.
2006/0180356 A1* 8/2006 Durairajan et al. ..... 175/431
2006/0185901 A1* 8/2006 Sinor et al. ..... 175/40
2006/0191723 A1 8/2006 Keshavan
2006/0207802 A1 9/2006 Zhang et al.
2006/0219439 A1 10/2006 Shen et al.
2006/0254830 A1 11/2006 Radtke

(56) References Cited

U.S. PATENT DOCUMENTS

| | | | | |
|---|---|---|---|---|
| 2006/0266558 | A1 | 11/2006 | Middlemiss et al. | |
| 2006/0266559 | A1 | 11/2006 | Keshavan et al. | |
| 2007/0029114 | A1 | 2/2007 | Middlemiss | |
| 2007/0079995 | A1 | 4/2007 | McClain et al. | |
| 2007/0135550 | A1 | 6/2007 | Chakrapani et al. | |
| 2007/0187155 | A1 | 8/2007 | Middlemiss | |
| 2007/0199739 | A1* | 8/2007 | Schwefe et al. | 175/426 |
| 2007/0235230 | A1 | 10/2007 | Cuillier et al. | |
| 2007/0261890 | A1 | 11/2007 | Cisneros | |
| 2007/0267227 | A1 | 11/2007 | Mensa-Wilmot | |
| 2007/0278014 | A1 | 12/2007 | Cariveau | |
| 2007/0278017 | A1 | 12/2007 | Shen et al. | |
| 2007/0284152 | A1 | 12/2007 | Eyre et al. | |
| 2008/0023231 | A1 | 1/2008 | Vail | |
| 2008/0047484 | A1 | 2/2008 | Sung | |
| 2008/0105466 | A1 | 5/2008 | Hoffmaster et al. | |
| 2008/0135297 | A1* | 6/2008 | Gavia | 175/57 |
| 2008/0142267 | A1 | 6/2008 | Griffin et al. | |
| 2008/0164071 | A1 | 7/2008 | Patel et al. | |
| 2008/0179106 | A1* | 7/2008 | Gavia et al. | 175/431 |
| 2008/0179107 | A1* | 7/2008 | Doster | 175/431 |
| 2008/0179108 | A1 | 7/2008 | McClain et al. | |
| 2008/0179109 | A1 | 7/2008 | Belnap et al. | |
| 2008/0206576 | A1 | 8/2008 | Qian et al. | |
| 2008/0223621 | A1 | 9/2008 | Middlemiss et al. | |
| 2008/0236899 | A1 | 10/2008 | Oxford et al. | |
| 2008/0236900 | A1 | 10/2008 | Cooley et al. | |
| 2008/0264696 | A1 | 10/2008 | Dourfaye et al. | |
| 2008/0302573 | A1* | 12/2008 | Sinor et al. | 175/57 |
| 2008/0302575 | A1 | 12/2008 | Durairajan et al. | |
| 2008/0308276 | A1 | 12/2008 | Scott | |
| 2009/0030658 | A1 | 1/2009 | Durairajan et al. | |
| 2009/0032169 | A1 | 2/2009 | Dourfaye et al. | |
| 2009/0032571 | A1 | 2/2009 | Smith | |
| 2009/0120008 | A1 | 5/2009 | Lockwood et al. | |
| 2009/0173014 | A1 | 7/2009 | Voronin et al. | |
| 2009/0173548 | A1 | 7/2009 | Voronin et al. | |
| 2009/0218416 | A1 | 9/2009 | Ohashi et al. | |
| 2009/0266619 | A1* | 10/2009 | Durairajan et al. | 175/431 |
| 2010/0025121 | A1* | 2/2010 | Schwefe | 175/431 |
| 2010/0084197 | A1 | 4/2010 | Voronin et al. | |
| 2010/0089661 | A1* | 4/2010 | Welch et al. | 175/428 |
| 2010/0104874 | A1 | 4/2010 | Yong et al. | |
| 2010/0155145 | A1* | 6/2010 | Pessier et al. | 175/336 |
| 2010/0288564 | A1 | 11/2010 | Dovalina, Jr. et al. | |
| 2010/0300767 | A1 | 12/2010 | Cariveau et al. | |
| 2010/0326740 | A1 | 12/2010 | Hall et al. | |
| 2011/0023377 | A1 | 2/2011 | DiGiovanni | |
| 2011/0024200 | A1 | 2/2011 | DiGiovanni et al. | |
| 2011/0031031 | A1 | 2/2011 | Vempati et al. | |
| 2011/0073379 | A1 | 3/2011 | DiGiovanni et al. | |
| 2011/0209922 | A1* | 9/2011 | King et al. | 175/402 |

FOREIGN PATENT DOCUMENTS

| | | | |
|---|---|---|---|
| EP | 0501447 | B1 | 11/2000 |
| EP | 0733776 | B1 | 9/2003 |
| EP | 1052367 | B1 | 4/2005 |
| JP | 11-165261 | A | 6/1999 |
| KR | 10-0853060 | B1 | 8/2008 |
| WO | 9929465 | A1 | 6/1999 |
| WO | 02/11876 | A2 | 2/2002 |
| WO | 2007089590 | A2 | 8/2007 |
| WO | 2007148060 | A1 | 12/2007 |
| WO | 2010097784 | A1 | 9/2010 |

OTHER PUBLICATIONS

Cetinkol, Mehmet et al. "Pressure dependence of negative thermal expansion in Zr2(WO4)(PO4)2." Solid State Communication. 149. (2009): 421-424.

Catafesta, Jadna. "Tunable Linear Thermal Expansion Coefficient of Amorphous Zirconium Tungstate." Journal of The American Cermamic Society. 89.7 (2006): 2341-2344.

Grzechnik, Andrzej et al. "Structural transformations in cubic ZrMo2O8 at high pressures and high temperatures." Solid State Sciences. 4. (2002): 1137-1141.

Chen, B et al. "High-pressure optical study of HfW2O8." Journal of Physics:Condensed Matter. 14. (2002): 13911-13916.

Ravindran, T.R. et al. "High Pressure Behavior of ZrW2O8: Gruneisen Parameter and Thermal Properties." American Physical Society: Physical Review Letters. 84.17 (2000): 3879-3882.

Ravindran, T.R. et al. "Erratum: High Pressure Behavior of ZrW2O8: Gruneisen Parameter and Thermal Properties." American Physical Society: Physical Review Letters. 85.1 (2000): 225.

Sleight, Arthur W. "Negative thermal expansion material." Current Opinion in Solid State & Materials Science. 3. (1998): 128-131.

Bertagnolli, K. E., and Vale, R., 2000, "Understanding and Controlling Residual Stresses in Thick Polycrystalline Diamond Cutters for Enhanced Durability," Proceedings, INTERTECH 2000: An International Technical Conference on Diamond,Cubic Boron Nitride and their Applications, Vancouver, BC, Jul. 17-21, 2000.

David, W.I.F., Evans, J.S.O., and Sleight, A.W., "Zirconium Tungstate: The Incredible Shrinking Material," 1997 ISIS Laboratory Scientific Highlights.

Clegg, J. "Faster and Longer Bit Runs With New-Generation PDC Cutter." Journal of Petroleum Technology. 58.12 (2006): 73-75.

Karasawa, Hirokazu. "Laboratory Testing to Design PDC Bits for Geothermal Well Drilling." National Institute for Resources and Environment . 40. (1992): 135-141.

Scott, Dan; "The History and Impact of Synthetic Diamond Cutters and Diamond Enhanced Inserts on the Oil and Gas Industry"; Industrial Diamond Review 1/06 (11 pages).

"US Synthetic Basics of PCD Manufacturing Training Course", Orem, Utah; Oct. 2003 (34 pages).

* cited by examiner

DRILL BIT FOR USE IN DRILLING SUBTERRANEAN FORMATIONS

CROSS-REFERENCE TO RELATED APPLICATION(S)

The present application claims priority to and the benefit of U.S. Provisional Patent Application No. 61/220,464, filed Jun. 25, 2009, entitled "Drill Bit for Use in Drilling Subterranean Formations," the entire disclosure of which is incorporated herein by reference.

BACKGROUND

1. Field of the Disclosure

The following is directed to drill bits for drilling subterranean formations and particularly drill bits comprising backup cutting elements having different cutting characteristics.

2. Description of the Related Art

The recovery of hydrocarbons or minerals from the earth is typically accomplished using a drill string that is driven from the surface of the earth into depths of the upper crust through a borehole. Various removal mechanisms can be used to advance the depth of the borehole including abrasion, fracturing, and shearing the subterranean formations at the bottom of the borehole. In fact, depending upon the type of subterranean formation, different types of drill bits are typically used, since different types of removal mechanisms are suitable for different types of formations.

Particular types of drill bits include fixed-cutter drill bits and roller cone drill bits. Roller cone drill bits can employ rolling elements, oftentimes cone shaped structures, capable of rotation relative to the drill bit head that can incorporate abrasive teeth extending from the surface. Roller cone drill bits typically advance through contacted subterranean formations through fracturing and abrading mechanisms. Fixed-cutter drill bits, by contrast, employ cutting elements made of hard material that are situated on the drill bit in a manner to shear and cut through contacted rock formations. Certain factors that determine the type of drill bit to be used include the hardness of the formation and the range of hardnesses to be encountered. Generally, conventional industry knowledge dictates that roller cone drill bits, particularly those incorporating tungsten carbide insert (TCI) cutting structures, have the best rate of penetration and lifetime in hard and superhard formations as compared to most fixed-cutter drill bits. While in formations of soft and medium hardness, fixed-cutter bits are commonly used. There remains a need in the art for development of drill bits capable of penetrating various types of rock formations.

SUMMARY

According to one aspect, a drill bit for drilling subterranean formations includes a drill bit body having a group of primary cutting elements comprising a first primary cutting element and a second primary cutting element radially spaced apart from each other along a first radial axis, and a group of backup cutting elements comprising a first backup cutting element in a secondary cutting position relative to the first primary cutting element and a second backup cutting element in secondary cutting positions relative to the second primary cutting element. The first and second backup cutting elements are radially spaced apart from each other along a second radial axis different than the first radial axis and comprise a difference in cutting characteristic relative to each other of one of a backrake angle and a siderake angle.

In accordance with another aspect of the present application, a drill bit for drilling subterranean formations includes a drill bit body having a group of primary cutting elements on a first blade, and a group of backup cutting elements on the first blade configured to engage a surface after wear of the group of primary cutting elements. The group of backup cutting elements includes a first backup cutting element and a second backup cutting element radially spaced apart from each other and different from each other in at least one cutting characteristic selected from the group of cutting characteristics consisting of cutting element size, cutting element shape, cutting element exposure, siderake angle, backrake angle, chamfer length, chamfer angle, radial offset, circumferential offset, and cutting element material.

According to yet another aspect of the present application, a drill bit for drilling subterranean formations includes a drill bit body having cutting elements attached to a blade of the drill bit body, the cutting elements including a group of primary cutting elements radially spaced apart from each other along a first radial axis, and a group of backup cutting elements placed in secondary cutting positions to the group of primary cutting elements. The group of backup cutting elements includes a first backup cutting element and a second backup cutting element radially spaced apart from each other along a second radial axis and comprising a difference in cutting characteristics including cutting element exposure and backrake angle.

In another aspect, a drill bit for drilling subterranean formations includes a drill bit body having a group of primary cutting elements including a first primary cutting element and a second primary cutting element radially spaced apart from each other, and a group of backup cutting elements circumferentially spaced apart from the primary cutting elements and configured to engage a surface after wear of the group of primary cutting elements. The group of backup cutting elements including a first backup cutting element having a first radial offset relative to the first primary cutting element and a second backup cutting element having a second radial offset relative to the second primary cutting element, wherein the first radial offset and second radial offset are different.

According to another aspect, a drill bit for drilling subterranean formations includes a drill bit body having cutting elements attached to the drill bit body including a group of primary cutting elements attached to the drill bit body in a primary and exposed position, and a group of backup cutting elements placed in secondary and underexposed positions relative to the group of primary cutting elements. The group of backup cutting elements includes a first backup cutting element and a second backup cutting element radially spaced apart from each other and different from each other in at least two cutting characteristics selected from the group of cutting element size, cutting element shape, siderake angle, chamfer length, chamfer angle, radial offset, circumferential offset, and cutting element material.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DETAILED DESCRIPTION

The following is directed to earth boring drill bits, and describes cutting elements to be incorporated in such drill bits. The terms "bit," "drill bit," and "matrix drill bit" may be used in this application to refer to "rotary drag bits," "drag bits," "fixed-cutter drill bits" or any other earth boring drill bit incorporating the teachings of the present disclosure. Such drill bits may be used to form well bores or boreholes in subterranean formations.

Figure 1:
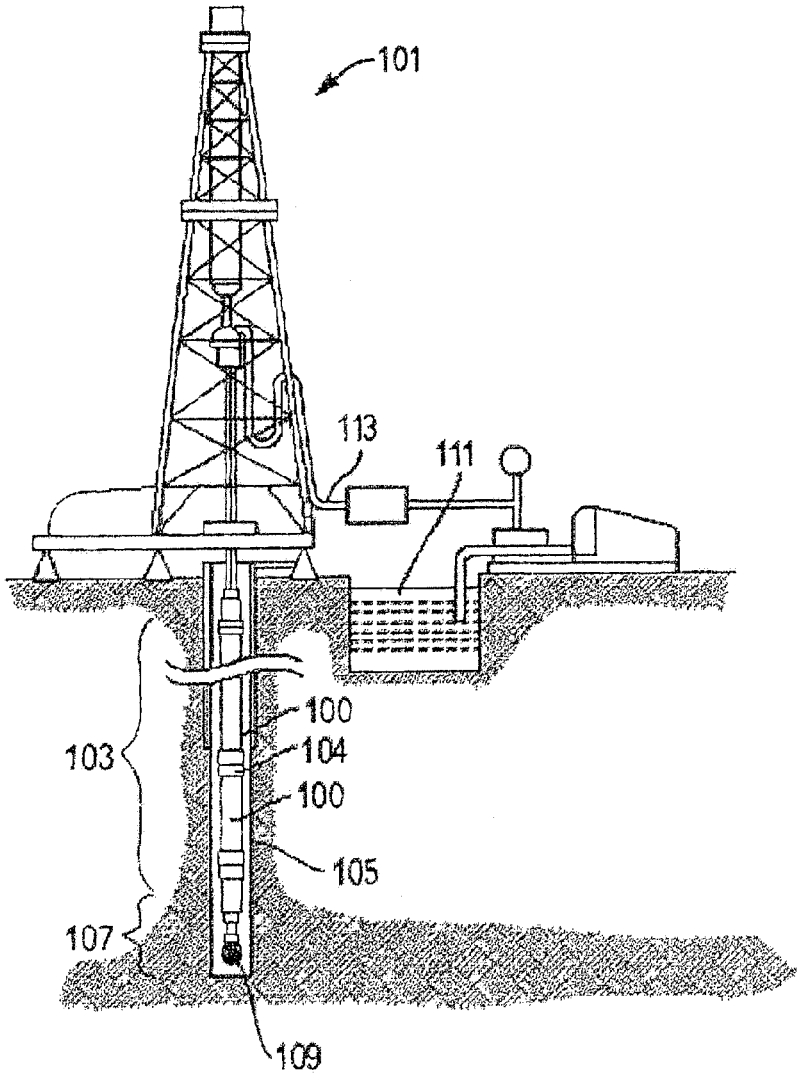
FIG. 1 includes a schematic of a drilling operation in accordance with an embodiment.

An example of a drilling system for drilling such well bores in earth formations is illustrated in FIG. 1. In particular, FIG. 1 illustrates a drilling system including a drilling rig 101 at the surface, serving as a station for workers to operate a drill string 103. The drill string 103 defines a well bore 105 extending into the earth and can include a series of drill pipes 100 that are coupled together via joints 104 facilitating extension of the drill string 103 for depths into the well bore 105. The drill string 103 may include additional components, such as tool joints, a kelly, kelly cocks, a kelly saver sub, blowout preventers, safety valves, and other components known in the art.

Moreover, the drill string 103 can be coupled to a bottomhole assembly 107 (BHA) including a drill bit 109 used to penetrate earth formations and extend the depth of the well bore 105. The BHA 107 may further include one or more drill collars, stabilizers, a downhole motor, MWD tools, LWD tools, jars, accelerators, push and pull directional drilling tools, point stab tools, shock absorbers, bent subs, pup joints, reamers, valves, and other components. A fluid reservoir 111 is also present at the surface that holds an amount of liquid that can be delivered to the drill string 103, and particularly the drill bit 109, via pipes 113, to facilitate the drilling procedure.

Figure 2:
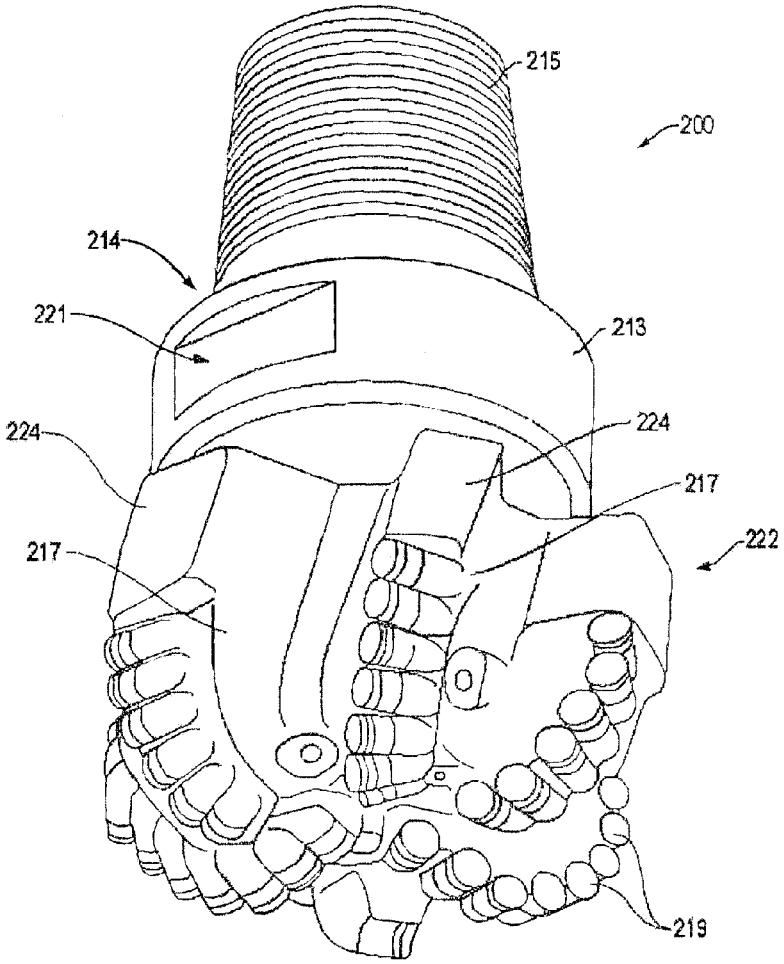
FIG. 2 includes a perspective view of a drill bit in accordance with an embodiment.

FIG. 2 includes a perspective view of a fixed-cutter drill bit 200. The fixed-cutter drill bit 200 has a bit body 213 that can be connected to a shank portion 214 via a weld. The shank portion 214 includes a threaded portion 215 for connection of the drill bit 200 to other components of the BHA 107, as shown in FIG. 1. The drill bit body 213 can further include a breaker slot 221 extending laterally along the circumference of the drill bit body 213 to aid coupling and decoupling of the drill bit 200 to other components.

The drill bit 200 includes a crown portion 222 coupled to the drill bit body 213. As will be appreciated, the crown portion 222 can be integrally formed with the drill bit body 213 such that they are a single, monolithic piece. The crown portion 222 can include gage pads 224 situated along the sides of protrusions or blades 217 that extend radially from the crown portion 222. Each of the blades 217 extend from the crown portion 222 and include a plurality of cutting elements 219 bonded to the blades 217 for cutting, scraping, and shearing through earth formations when the drill bit 200 is rotated during drilling. The cutting elements 219 may be tungsten carbide inserts, polycrystalline diamond compacts (PDCs), milled steel teeth, or any of the cutting elements described herein. Coatings or hardfacings may be applied to the cutting elements 219 and other portions of the bit body 213 or crown portion 222 to reduce wear and increase the life of the drill bit 200.

Figure 3:
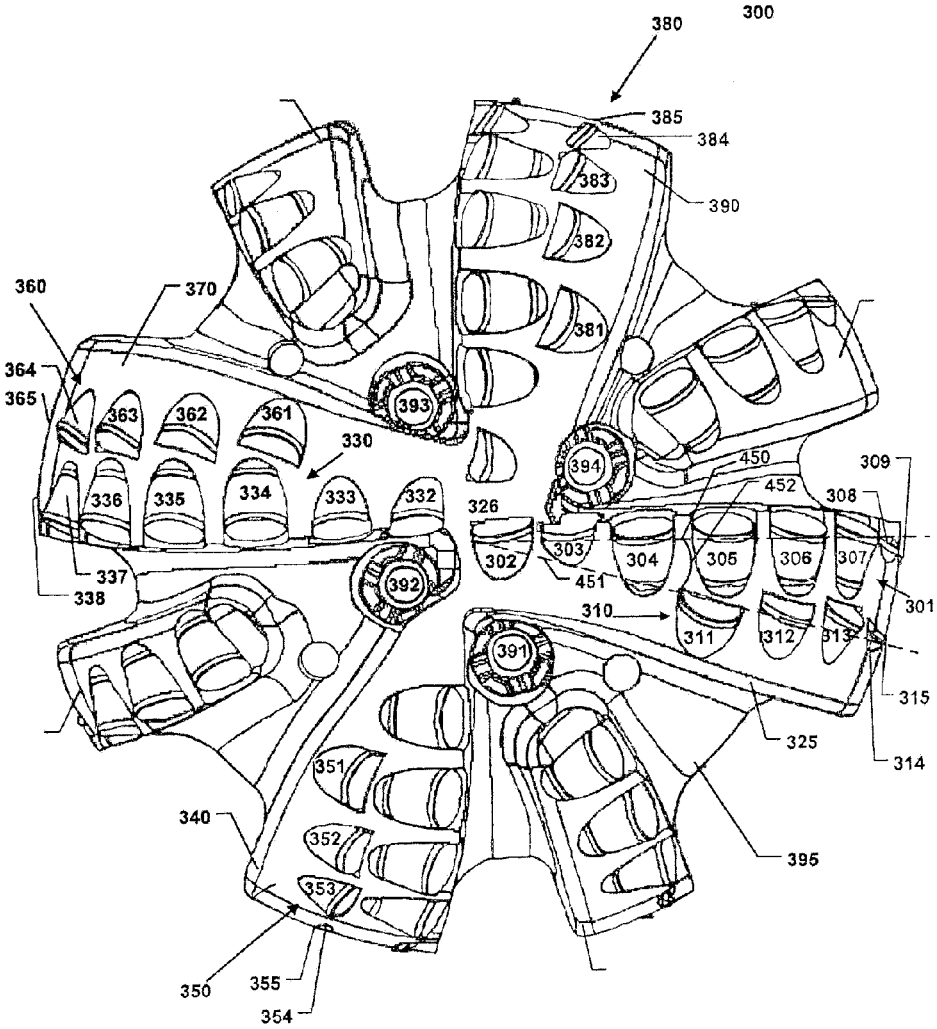
FIG. 3 shows a top view of a drill bit in accordance with an embodiment.

FIG. 3 includes a top view of a drill bit 300 in accordance with an embodiment. The drill bit 300 includes a drill bit body 326 that comprises a plurality of blades extending radially from the center of the drill bit body 326. While the design of the drill bit 300 can vary, as can the number and shape of the blades, the illustrated embodiment of FIG. 3 includes eight blades, including, blade 321, blade 322, blade 323, blade 324, blade 325, blade 340, blade 370, and blade 390 that extend radially from the drill bit body 326. As further illustrated, the drill bit 300 includes a group of nozzles 391, 392, 393, and 394 (391-394), which are positioned around the drill bit body 326 such that during a drilling operation, fluid may be ejected from the nozzles 391-394 to aid removal of material from the cutting elements contained on the blades. Moreover, the drill bit 300 includes junk slots including, for example, junk slots 395 that are channels formed along the drill bit body 326 and positioned between the blades such as between blades 321, 325, and 340 to aid swarf removal during operation.

The drill bit body 326 comprises a group of primary cutting elements 301 that extend along a radial axis 450 extending from a central point of the drill bit body 326 on the blade 325. The group of primary cutting elements 301 includes primary cutting elements 302, 303, 304, 305, 306, 307, 308, and 309, respectively, which are radially spaced apart from each other along the radial axis 450. As further illustrated, the drill bit body 326 includes a group of backup cutting elements 310, which are radially spaced apart from each other, wherein the group includes backup cutting elements 311, 312, 313, 314, and 315, respectively, that extend radially along a radial axis 451. The group of backup cutting elements 310 include cutting elements that are arranged in secondary cutting positions relative to corresponding primary cutting elements. That is, the backup cutting elements are located in a secondary cutting position relative to the group of primary cutting elements 301 such that they are configured to engage a surface, such as a rock formation in the bottom of a well bore, subsequent to the engagement of the same surface by the corresponding primary cutting elements 302-309. More particularly, the backup cutting elements 310 are in secondary cutting positions relative to their corresponding primary cutting elements 301, such that each backup cutting element is configured to engage the rock surface of the well bore after some wear to the corresponding primary cutting element. For example, the backup cutting element 311 is in a secondary cutting position relative to the primary cutting element 305, and the backup cutting element 312 is in a secondary cutting position relative to the primary cutting element 306.

The group of primary cutting elements 301 and group of secondary cutting elements 310 extend along different radial axes 450 and 451, respectively. When determining the extension of radial axes 450 and 451, it is typically completed in such a manner that the axes 450 and 451 extend through a majority of the surfaces of the respective cutting elements. In particular, the axes 450 and 451 can extend along the joint between the cutting element body and the cutting element table or face. Notably, the first radial axis 450 and second radial axis 451 can be separated by a radial angle 452. In certain designs, the drill bit body 326 can be formed such that the radial angle 452 is not greater than about 45 degrees. In other instances, the radial angle 452 can be not greater than about 35 degrees, such as not greater than about 25 degrees, or even not greater than about 15 degrees. Certain drill bit designs utilize the radial angle 452 that is within a range between about 1 degree and about 45 degrees, such as between about 1 degree and 35 degrees, between 5 degrees and 25 degrees, and more particularly between 5 degrees and 15 degrees.

According to the illustrated embodiment of FIG. 3, the blade 325 of the drill bit body 326 comprises at least about 10 cutting elements from the group of primary cutting elements 301 and group of secondary cutting elements 310. In certain other designs, the number of cutting elements may be greater, such as at least about 11, 12, 13, 14, or even 15. Moreover, it will be appreciated that the arrangement of cutting elements of the drill bit body 326 may vary from that of the illustrated embodiment of FIG. 3.

The illustrated embodiment of FIG. 3 utilizes a group of backup cutting elements 310 situated on the blade 325, to which the group of primary cutting elements 301 are also affixed. In certain alternative embodiments, the group of backup cutting elements 310 may be affixed to a different blade than the group of primary cutting elements 301, such as a smaller blade (e.g., 321), while maintaining the secondary cutting position.

As further illustrated, the drill bit 300 may have a symmetry based upon the center of the drill bit body 326 with respect to the arrangement of the blades. In particular, the blades 325 and 370 are separate from each other in a circumferential manner along the drill bit body 326 by approximately 180 degrees. Notably, the blades 325 and 370 of the illustrated embodiment have comparable symmetry in that each of the blades 325 and 370 contain the greatest number of cutting elements as compared to the other blades of the drill bit body 326. In particular, the blade 370 includes a group of primary cutting elements 330 including cutting elements 332, 333, 334, 335, 336, 337, and 338 radially spaced apart from each other along a primary radial axis. The blade 370, like blade 325, further incorporates a group of backup cutting elements 360 including cutting elements 361, 362, 363, 364, and 365, which are oriented in secondary cutting positions relative to corresponding primary cutting elements and radially spaced apart from each other along a secondary radial axis different than the primary radial axis.

The drill bit body 326 also includes secondary blades 340 and 390 that are separate from each other in a circumferential manner along the drill bit body 326 by approximately 180 degrees. Like the blades 325 and 370, the blades 340 and 390 comprise groups of primary cutting elements and a group of backup cutting elements in secondary positions relative to corresponding primary cutting elements. Notably, the blade 340 comprises a group of backup cutting elements 350 including backup cutting elements 351, 352, 353, 354, and 355. The blade 390 includes a group of backup cutting elements 380 that includes backup cutting elements 381, 382, 383, 384, and 385. In certain designs, the secondary blades 340 and 390 may contain a fewer number of cutting elements (i.e., primary and backup cutting elements) than the blades 325 and 370.

The drill bit body 326 comprises further symmetry in that it comprises minor blades 321, 322, 323, and 324, which are circumferentially spaced apart from each other along the drill bit body 326 and oriented between the previously identified blades (i.e., blade 325, blade 340, blade 370, and blade 390). Notably, the blades 321-324 may contain a single group of cutting elements, such as a primary group of cutting elements, and may not necessarily include a group of backup cutting elements in secondary cutting positions relative to corresponding primary cutting elements. It will be appreciated however, that in certain embodiments, a group of backup cutting elements, such as the group of backup cutting elements 310 may not necessarily be positioned on the blade 325, and the group of cutting elements on the blade 321 may be oriented such that they are backup cutting elements oriented in a secondary cutting position relative to the group of primary cutting elements 301 on the blade 325.

The drill bits according to embodiments herein incorporate a group of backup cutting elements having certain cutting characteristics suitable for improved operation of the drill bit. In particular, the drill bit 300 includes groups of backup cutting elements that have differences in cutting characteristics relative to each other within the same group of backup cutting elements that may improve performance of the drill bit. As used herein, reference to cutting characteristics is reference to the following features including cutting element size, cutting element shape, cutting element exposure, siderake angle, backrake angle, chamfer length, chamfer angle, radial offset, circumferential offset, cutting element material, and a combination thereof. Notably, any of the backup cutting elements within a group are formed such that they have at least one cutting characteristic that is different than another backup cutting element within the same group. For example, the backup cutting element 311 can comprise a cutting characteristic (e.g., backrake angle) that is different than the same cutting characteristics (i.e., backrake angle) as compared to any of the other backup cutting elements 312, 313, 314, or 315 within the same group 310. In other designs, any one of the backup cutting elements 311-315 can be formed such that they comprise at least two different cutting characteristics relative to any other of the backup cutting elements 311-315 within the same group of backup cutting elements 310. In still other embodiments, a greater number of cutting characteristics may be different between one of the backup cutting elements and other backup cutting elements within the same group. That is, one backup cutting element may have at least 3, at least 4, or even at least 5 cutting characteristics that are different than any of the other backup cutting elements within the same group. Herein, reference will be made to the group of primary cutting elements 301 and the group of backup cutting elements 310 with regard to differences in cutting characteristics, and it will be appreciated that any such differences detailed herein can be applied to any group of backup cutting elements on the drill bit 300.

Figure 4:
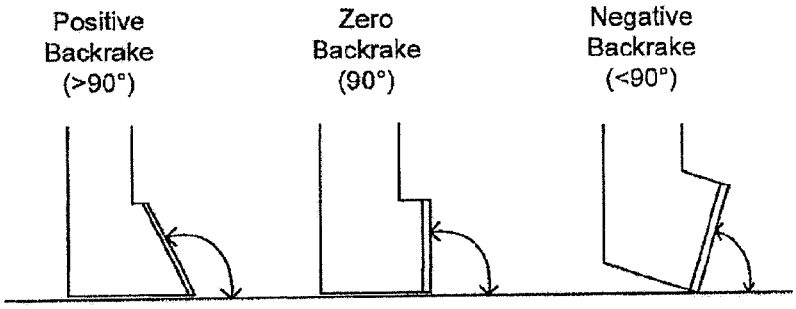
FIG. 4 provides side view illustrations of various backrake angles for use in cutting elements in accordance with an embodiment.

In accordance with one particular embodiment, the group of backup cutting elements 310 are formed such that the backup cutting elements 311-315 comprise a difference in cutting characteristics of backrake angle or siderake angle relative to each other. Referring to FIG. 4, a schematic of backrake angle is provided to illustrate differences in backrake angles that can be employed with any one of the backup cutting elements 311-315. As shown in FIG. 4, the backrake angle describes the orientation between the face of the cutting element relative to a surface to be engaged by the cutting element. A positive backrake angle is one in which the surface of the cutting element is greater than 90 degrees relative to the surface to be engaged by the cutting element. A zero backrake angle is one in which the surface of the cutting element is perpendicular to the surface to be engaged by the cutting element, that is approximately 90 degrees to relative to the surface. Still, a cutting element having a negative backrake is one in which the surface of the cutting element is oriented to create an angle of less than 90 degrees relative to the surface it is intended to engage.

In certain designs, the drill bit 300 can be formed such that any two of the backup cutting elements 311-315 within the same group of the backup cutting elements 310 can have a difference in backrake angle relative to each other of at least about 2 degrees. In other embodiments, this difference in backrake angle between the backup cutting elements can be at least about 5 degrees, at least about 8 degrees, at least about 10 degrees, at least about 15 degrees, at least about 20 degrees, or even at least about 30 degrees relative to each other. In particular instances, the difference in backrake angle between any two backup cutting elements within the same group of backup cutting elements 310 can be within a range between about 2 degrees and about 60 degrees, such as between about 2 degrees and about 50 degrees, or between 2 degrees and about 40 degrees, or even between about 2 degrees and about 30 degrees. It will be appreciated, that two or more of the backup cutting elements within the same group of backup cutting elements can differ from one another based on backrake angle, and in particular instances, each of the backup cutting elements within the same group can comprise a different backrake angle relative to all other backup cutting elements in the same group.

Certain designs of the drill bit body 326 may be employed such that the backrake angle of each of the backup cutting elements 311-315 within the same group of backup cutting elements 310 may form a pattern. For example, the backrake angle of the backup cutting elements 311-315 of the group of backup cutting elements 310 can be increased with increasing radial distance from the center of the drill bit body 326 along the radial axis 451. That is, the backup cutting element 311 may comprise a zero backrake angle, while the backup cutting element 312 comprises a negative backrake angle of 85 degrees, and the backup cutting element 313 comprises a still greater negative backrake angle of 80 degrees, and so on. In still other embodiments, the backrake angle of each of the backup cutting elements 311-315 may be decreased with increasing radial distance from the center point of the drill bit body 326 along the radial axis 451. For example, the backup cutting element 311 may comprise a negative backrake angle of 60 degrees, while the backup cutting element 312 comprises a less aggressive negative backrake angle of 65 degrees, and the backup cutting element 313 comprises an even less aggressive, negative backrake angle of 70 degrees, and so on.

Still in other designs, the backrake angle of the backup cutting elements 311-315 within the group of backup cutting elements 310 may be employed such that the backrake angle both increases and decreases. For example, the backrake angle of the backup cutting elements 311-315 within the group of backup cutting elements 310 may be set such that it is most aggressive at a central location (e.g., cutting elements 313 and/or 314) and less aggressive at the end of the group 310 of backup cutting elements (e.g., backup cutting elements 311 and/or 315).

The drill bits of embodiments herein can be formed such that any of the cutting characteristics of any of the backup cutting elements within a set can be different from each other. Reference herein to a set of backup cutting elements is reference to backup cutting elements having the same radial position and circumferentially spaced apart from each other through the drill bit body 326. In particular, backup cutting elements of a set can be positioned on different blades from each other. For example, one set of backup cutting elements includes backup cutting element 311 of blade 325, backup cutting element 351 of blade 340, backup cutting element 361 of blade 370, and backup cutting element 381 of blade 390. In accordance with an embodiment, any of the backup cutting elements 311, 351, 361, and 381 within the set of backup cutting elements can have a different cutting characteristics (e.g., backrake angle) compared to any other backup cutting element within the set. However, certain drill bits may employ a set of backup cutting elements having the same cutting characteristics.

Notably, in one embodiment, the drill bit 300 is formed such that at least two of the backup cutting elements within a set of backup cutting elements comprise a difference in the backrake angle relative to each other. Notably, the difference in backrake angle between any two backup cutting elements within a set of backup cutting elements can vary by the same value of degrees as noted above with regard to the difference in backrake angle between backup cutting elements within a group. For example, in certain embodiments, the difference in backrake angle between any of the backup cutting elements within the same set is within a range between about 1 degree and about 20 degrees, between about 1 degree and about 15 degrees, between about 1 degree and 10 degrees, or even between about 1 degree and about 5 degrees. As will be appreciated, the backup cutting elements within the same set can have the same cutting characteristics compared to each other.

Figure 5:
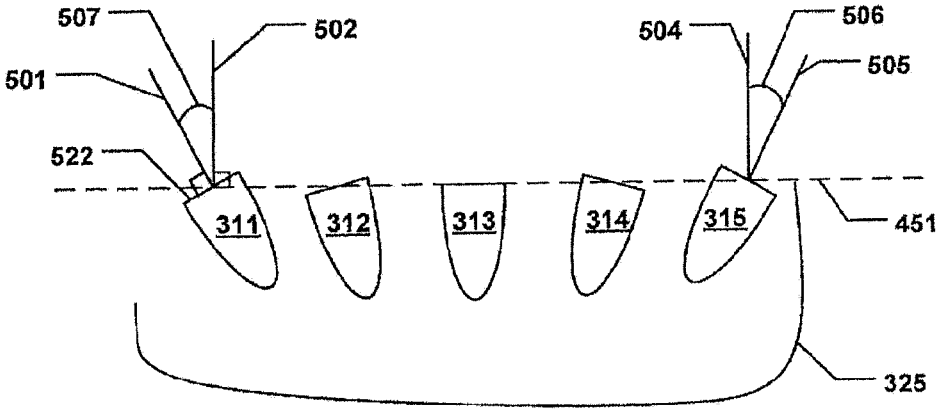
FIG. 5 includes an illustration of backup cutting elements having various siderake angles in accordance with an embodiment.

As described herein, another cutting characteristic that may be varied between any one of the backup cutting elements 311-315 within the same group is siderake angle. Referring to FIG. 5, a top view illustration of the backup cutting elements 311-315 is provided. As used herein, reference to a siderake angle is a reference to an angular difference between an axis extending normal to the cutting element face and an axis extending normal to the radial axis 451 upon which the backup cutting elements 311-315 are set. In accordance with an embodiment, the siderake angle between any two backup cutting elements 311-315 within the same group of backup cutting elements 310 can vary relative to each other by at least about 2 degrees. In other embodiments, the difference in siderake angle between at least two of the backup cutting elements 311-315 can be greater, such as on the order of at least 5 degrees, at least about 10 degrees, at least about 15 degrees, or even at least about 20 degrees. Particular designs may utilize a difference in siderake angle between at least two of the backup cutting elements 311-315 in the same group of backup cutting elements 310 within a range between about 2 degrees and about 45 degrees. In other instances, this difference may be between about 2 degrees and 30 degrees, or even between about 2 degrees and 20 degrees.

As further illustrated in FIG. 5, the siderake angle of the backup cutting elements 311-315 may be ordered such that there is a pattern. For example, as illustrated in FIG. 5, the backup cutting element 311 can be formed such that it has an axis 501 extending normal to a cutting face 522 thereof that forms a siderake angle 507 relative to an axis 502 that extends normal to the axis 451 such that the angle 507 is a negative siderake angle. By contrast, another backup cutting element, such as backup cutting element 315 may be oriented within the drill bit 300 to have a positive siderake angle 506 as defined between an axis 505 that extends normal to the cutting face of the backup cutting element 315 and an axis 504 that extends normal to the radial axis 451. According to the embodiment of FIG. 5, a pattern is formed with regard to the siderake angle and the position of the backup cutting element along the radial axis 451. As illustrated, the siderake angle changes from the backup cutting element 311 to backup cutting element 315 from a negative siderake angle (507) to a positive siderake angle (506). It will be appreciated, that in other designs, the backup cutting elements 311-315 may be arranged to employ a different pattern, such as from a positive siderake angle to a negative siderake angle moving from the backup cutting element 311 to backup cutting element 315 as position along the radial axis 451 changes. In still other embodiments, the drill bit 300 can be designed such that the backup cutting elements 311-315 can have alternating positive and negative siderake angles. Other alternative designs may employ a random combination of positive, negative, and/or no siderake angle for each of the backup cutting elements 311-315.

As described herein, the drill bit 300 can be formed such that the siderake angle of any of the backup cutting elements within a set (e.g., backup cutting elements 311, 351, 361, and 381) can be different relative to each other. However, it will be appreciated that for certain designs, each of the backup cutting elements 311, 351, 361, and 381 within the set can employ the same siderake angle relative to each other.

Another cutting characteristic that can be different between any of the backup cutting elements 311-315 within a group includes the cutting element exposure. As used herein, cutting element exposure is reference to an amount or difference in exposure between a backup cutting element and its corresponding primary cutting element. For example, the backup cutting element 311 is positioned in a secondary cutting position relative to its corresponding primary cutting element 305. The difference in height (measured axially) of the upper points of the cutting faces between the primary cutting element 305 and the backup cutting element 311 can be defined as the amount of exposure for the backup cutting element 311. For example, if the primary cutting element 305 protrudes from the surface of the bit body 326 such that the highest point of the cutting surface is 3 mm above the bit body, and the corresponding backup cutting element 311 protrudes from the surface of the bit body 326 such that the highest point of the cutting surface is 1 mm above the bit body, the cutting element exposure is a negative 2 mm (−2.0 mm) of cutting element exposure.

Figure 6:
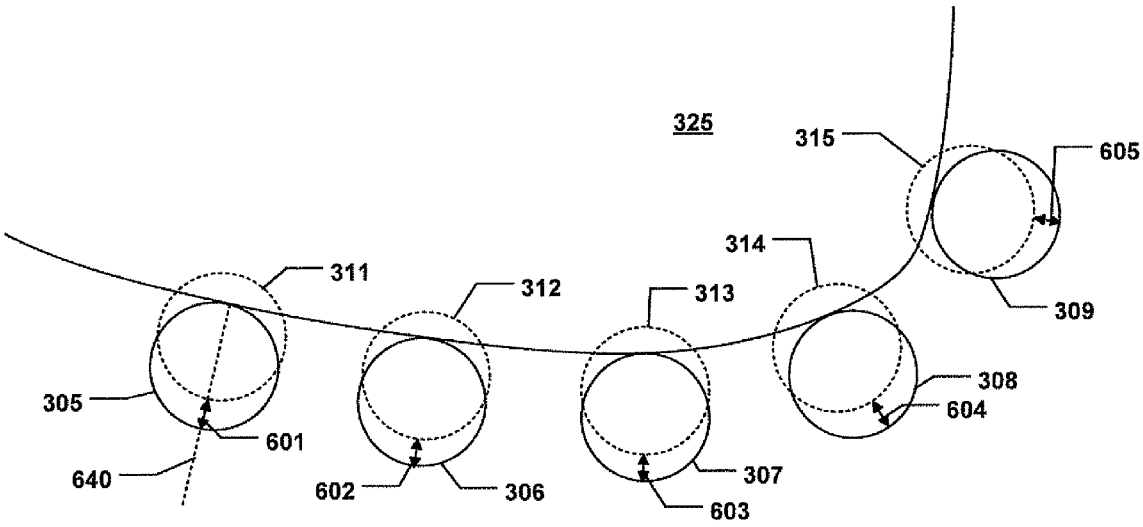
FIG. 6 includes a cross-sectional illustration of a portion of a blade including cutting elements having various exposures in accordance with an embodiment.

In reference to FIG. 6, a cross-sectional illustration of a portion of a blade is provided including primary cutting elements and corresponding backup cutting elements to illustrate differences in cutting element exposures 601, 602, 603, 604, and 605 between the backup cutting elements 311-315 within the same group in accordance with an embodiment. As illustrated in FIG. 6, the primary cutting elements 305, 306, 307, 308, and 309 are situated along the surface of the blade 325 radially spaced apart from each other. The primary cutting elements 305-309 are positioned to handle a majority of the initial cutting and shearing of a rock formation. As further illustrated, the blade 325 includes backup cutting elements 311-315 disposed in secondary cutting positions relative to each of their corresponding primary cutting elements 305-309, respectively. The primary cutting element 305 and backup cutting element 311 are oriented with respect to each other such that a first cutting element exposure 601 is defined as the distance in an axial direction between the uppermost points of the cutting faces of the respective cutting elements at a point along an axis 640, which extends perpendicular to the blade 325 and through the center of the primary cutting element 311.

By comparison, the primary cutting element 306 and corresponding backup cutting element 312 define a cutting element exposure 602 defined as the difference in distance between the uppermost points of the cutting faces of the respective cutting elements. In accordance with embodiments herein, the backup cutting elements 311-315 may be oriented relative to their corresponding primary cutting elements 305-309 such that they define different cutting element exposures relative to other backup cutting elements within the group of backup cutting elements 310. For example, in accordance with one particular embodiment, drill bits herein can incorporate backup cutting elements that have a difference in cutting element exposure distance of at least 5% based on the cutting element exposure having the greater value. That is, when comparing the cutting element exposure distances (CEEDs) 602 and 601, the percentage difference between the two cutting element exposure distances can be calculated using the equation ((CEED1−CEED2)/CEED1) wherein CEED1≥CEED2. In certain embodiments, the drill bit can be designed such that the difference in cutting element exposure between two backup cutting elements and their corresponding primary cutting elements is at least about 10%, such as at least about 25%, at least about 50%, or even at least about 75%. In particular instances, the drill bits herein can have a difference in cutting element exposure distance of between about 5% and about 100%, between 5% and about 75%, such as on the order of between about 10% and about 65%, between about 10% and 60%, between 15% and about 50%, or even 15% and about 40%.

The embodiment of FIG. 6 illustrates backup cutting elements 311-315 being underexposed with respect to each of their corresponding primary cutting elements 305-309. That is, the backup cutting elements 311-315 have less exposure, as measured from the uppermost point on the face of the cutting element to the surface of the blade 325 that is less than the exposure of the corresponding primary cutting elements 305-309. However, embodiments herein may also utilize backup cutting elements 311-315 that have an overexposure orientation with respect to corresponding primary cutting elements 305-309. An overexposure orientation is one in which the backup cutting element has a greater exposure than its corresponding primary cutting element. Backup cutting elements having an overexposure can be configured to engage the surface of a rock formation in a borehole simultaneously with or even before the corresponding primary cutting element engages the surface.

In reference to particular values, the difference in cutting element exposure between two backup cutting elements and their corresponding primary cutting elements can be at least about 0.1 mm. In other instances, this difference can be greater, such as at least about 0.25 mm, at least about 0.5 mm, at least about 1 mm, at least about 2 mm, at least about 3 mm, or even at least about 5 mm. Particular designs utilize a difference in cutting element exposure between any two backup cutting elements and their corresponding primary cutting elements within a range between about 0.1 mm and about 10 mm, such as between 0.1 mm and about 8 mm, between about 0.1 and about 6 mm, or even between 0.1 mm and about 5 mm. The foregoing embodiments utilize a difference in cutting element exposure between two backup cutting elements within the same group, however, it will be appreciated that some backup cutting elements within the same group may have the same cutting element exposure relative to their corresponding primary cutting elements and therefore may not exhibit a difference in cutting element exposure.

As will further be appreciated, drill bits herein may be designed such that there is a gradual change, trend, or even pattern in the cutting element exposure between backup cutting elements 311-315 within the same group depending upon the radial position of the backup cutting element. For example, in certain embodiments, the cutting element exposure for each backup cutting element 311-315 may increase as its distance along the radial axis 451 increases from the center of the drill bit body 326. In still other embodiments, the cutting element exposure for each backup cutting element 311-315 may decrease with increasing distance from the center of the drill bit body 326 along the radial axis 451. In still other embodiments, it may be suitable such that the cutting element exposure for each of the backup cutting elements 311-315 exhibits multiple trends (i.e., increasing first and then decreasing) with respect to the distance from the center of the drill bit body 326 along the radial axis 451.

In accordance with other embodiments, backup cutting elements within a set (e.g. backup cutting element 311 of blade 325, backup cutting element 351 of blade 340, backup cutting element 361 of blade 370, and backup cutting element 381 of blade 390) may comprise the same cutting element exposure value. However, it will be appreciated that in alternative designs, any one of the backup cutting elements within a set of backup cutting elements can have a cutting element exposure that is different than the cutting element exposure of any one of the other backup cutting elements within the same set.

Figure 7:
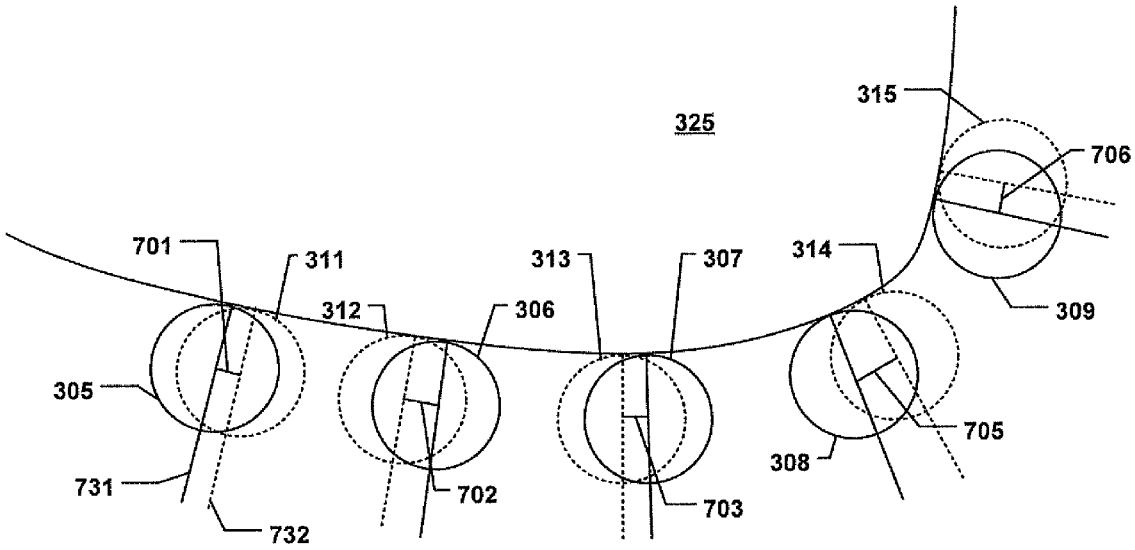
FIG. 7 includes a cross-sectional illustration of a portion of a blade including cutting elements having various radial offsets in accordance with an embodiment.

In further reference to other particular cutting characteristics, the radial offset between any two backup cutting elements 311-315 within the group of backup cutting elements 310 may be different relative to each other. FIG. 7 includes a cross-sectional illustration of a portion of a blade comprising primary cutting elements and corresponding backup cutting elements in accordance with an embodiment. In particular, FIG. 7 illustrates the radial offset between primary cutting elements 305, 306, 307, 308, and 309 relative to the corresponding backup cutting elements 311, 312, 313, 314, and 315. Radial offset is a measure in the difference in radial position (i.e., along respective radial axes) between the centers of a primary cutting element and the center of the corresponding backup cutting element. For example, the primary cutting element 305 has a radial position defined by an axis 731 extending through the center of the primary cutting element 305 and normal to the surface of the blade 325. The backup cutting element 311 has a radial position defined by an axis 732 that extends through the center of the backup cutting element 311 normal to the surface of the blade 325. The difference between axis 731 and axis 732 is the radial offset 701 as measured between the two centers of the cutting elements 305 and 311. As further illustrated, the primary cutting element 306 and backup cutting element 312 comprise a radial offset 702, while the primary cutting element 307 and backup cutting element 313 comprise a radial offset 703. The primary cutting element 308 and backup cutting element 314 comprise a radial offset 705, and the primary cutting element 309 and corresponding backup cutting element 315 comprise a radial offset 706.

According to particular drill bit designs, the difference in radial offset between any two backup cutting elements and their corresponding primary cutting elements can be at least about 5% based on the greater of the radial offsets. That is, the radial offset ($RO_1$) of between a first primary cutting element and the corresponding first backup cutting element and the radial offset ($RO_2$) between a second primary cutting element and the corresponding second backup cutting element can be described by the equation: $((RO_1-RO_2)/RO_1)$ wherein $RO_1 \geq RO_2$. In certain embodiments, the drill bit can be designed such that the difference in radial offset between two backup cutting elements within the same group and their corresponding primary cutting elements can be at least about 10%, such as at least about 25%, at least about 50%, or even at least about 75%. In particular instances, the drill bits herein can have a difference in cutting element exposure distance of between about 5% and about 100%, between 5% and about 75%, such as on the order of between about 5% and about 50%, between about 5% and 30%, between 5% and about 25%, or even 5% and about 10%.

In more particular terms, the difference in radial offset between two backup cutting elements within the same group and their corresponding primary cutting elements can be at least about 0.1 mm. That is, the difference in a radial offset 701 of the backup cutting element 311 from a radial offset 702 of the backup cutting element 312 can be at least about 0.1 mm. In other embodiments, the difference in the radial offset between any two backup cutting elements and the corresponding primary cutting elements can be greater, such as on the order of at least about 0.25 mm, at least about 0.5 mm, at least about 1 mm, at least about 2 mm, or even at least 3 mm. In particular instances, the difference in radial offset between any two backup cutting elements and corresponding primary cutting elements can be within a range between about 0.1 mm and about 10 mm, such as on the order of between 0.1 mm and 8 mm, between about 0.1 mm and about 6 mm, and more particularly between 0.1 mm and 5 mm. As will be appreciated, the difference in radial offset may extend to a greater number of backup cutting elements than two. For example, there may be a difference in radial offset between three of the backup cutting elements, at least about four of the backup cutting elements, or even between all of the backup cutting elements with the same group of backup cutting elements.

Furthermore, in certain instances, certain backup cutting elements can have a radial offset in a different direction relative to another backup cutting element and its corresponding primary cutting element. For example, the backup cutting element 311 is illustrated as being shifted radially outward (i.e., away from the center of the drill bit body 326) relative to the primary cutting element 305. By contrast, the backup cutting element 312 is illustrated as being shifted radially inward (i.e., toward the center of the drill bit Body 326) relative to its corresponding primary cutting element 306. As such, a further distinction may exist between any two backup cutting elements in that one backup cutting element may be shifted in a radially outward direction, while a corresponding and different backup cutting element within the group can be shifted in a radially inward direction.

It will further be appreciated that with regard to sets of backup cutting elements, that is, backup cutting elements having generally the same radial position but circumferentially spaced apart, can have a same radial offset relative to each other. However, in other designs it may be suitable that any one of the backup cutting elements within a set comprises a different radial offset relative to its corresponding primary cutting element than any other backup cutting element within the set relative to its primary cutting element.

Figure 8:
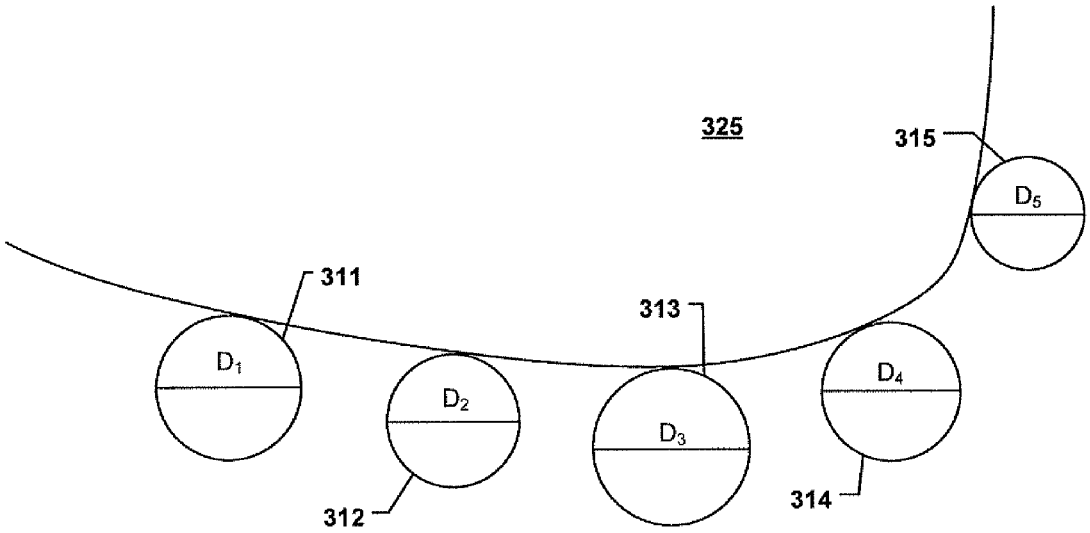
FIG. 8 includes a cross-sectional illustration of a portion of a blade including cutting elements having various cutting element sizes in accordance with an embodiment.

In further reference to particular differences in cutting characteristics, drill bit designs herein can utilize backup cutting elements having different cutting element sizes relative to other backup cutting elements within the same group. FIG. 8 includes a cross-sectional illustration of a portion of a blade comprising backup cutting elements according to an embodiment. In particular, the blade 325 is illustrated as including backup cutting elements 311, 312, 313, 314, and 315. As illustrated, the backup cutting elements 311-315 comprise circular cross-sectional contours wherein each of the cutting elements comprise a diameter D1, D2, D3, D4, and D5, respectively. As illustrated, any one of the backup cutting elements 311-315 can be formed such that it has a different cutting element size as compared to another backup cutting element within the group of backup cutting elements 310. That is, for example, in comparison of backup cutting elements 311 and 312, the backup cutting element 312 has a smaller diameter D2, and therefore size in terms of available area of the cutting surface, than backup cutting element 311 having a diameter D1.

Certain drill bit designs can utilize a difference in cutting element sizes between any two backup cutting elements within the same group such that the difference is and at least about 5% based on the greater of the cutting element diameters. For example, the difference in cutting element sizes between any two backup cutting elements within the same group can be described by the equation $((D_L-D_S)/D_L)$ wherein $D_L \geq D_S$ and $D_L$ represents the backup cutting element having the diameter greater as compared to the diameter of the other, smaller backup cutting element $D_s$. In certain embodiments, the drill bit can be designed such that the difference in cutting element size between any two backup cutting elements within the same group can be at least about 10%, such as at least about 25%, at least about 50%, or even at least about 75%. In particular instances, the drill bits herein can have a difference in cutting element size of between about 5% and about 100%, between 5% and about 75%, such as on the order of between about 5% and about 50%, between about 5% and 30%, between 5% and about 25%, or even 5% and about 10%.

According to particular embodiments using cutting elements having circular cross-sectional contours, the difference in cutting element diameters can be at least 2 mm, at least about 5 mm, at least about 10 mm, at least about 15 mm, and in some cases at least about 20 mm. In certain designs, the difference in diameter between cutting elements can be between 2 mm and about 20 mm, such as between about 2 mm and about 18 mm, between 5 mm and about 15 mm. Use of different cutting element sizes with respect to various backup cutting elements within a group may facilitate improved cutting performance. For example, larger cutting elements, including, for example, backup cutting elements 312 and 313 may be provided in positions of higher expected wear such that they may provide a greater amount of cutting power to key areas of the drill bit.

As will be appreciated, backup cutting elements within a set, that is backup cutting elements having the same radial position yet circumferentially spaced apart from each other along the drill bit body, can have the same cutting element size. However, in certain other drill bits, it may be suitable that various backup cutting elements within a set may differ from each other based on cutting element size.

Figure 9:
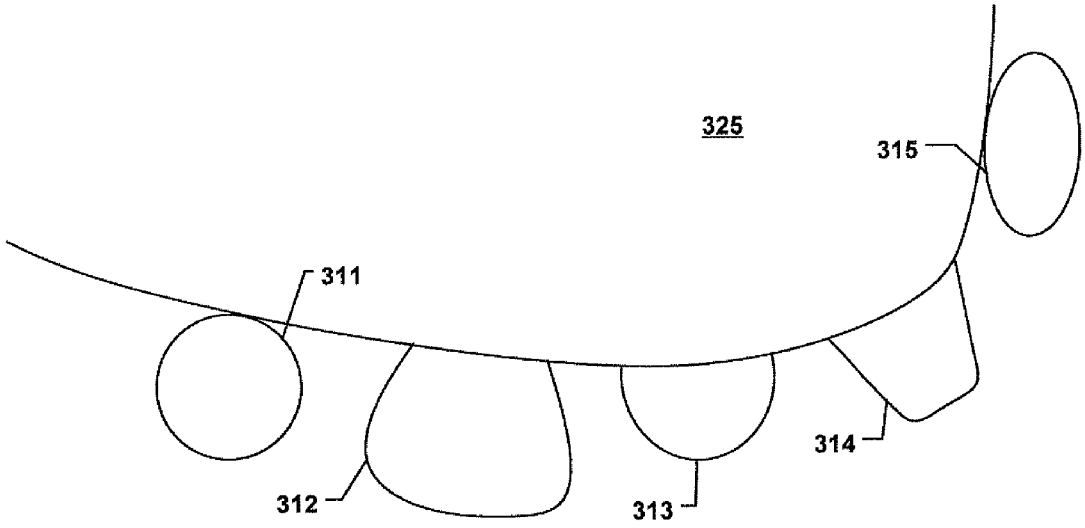
FIG. 9 includes a cross-sectional illustration of a portion of a blade including cutting elements having various cutting element shapes in accordance with an embodiment.

FIG. 9 includes a cross-sectional illustration of a portion of a blade 325 comprising backup cutting elements in accordance with an embodiment. Notably, FIG. 9 illustrates that backup cutting elements 311, 312, 313, 314, and 315 can have different cross-sectional shapes as compared to each other. According to embodiments herein, any one of the backup cutting elements 311-315 can have a cutting shape (as viewed in cross-section) that is different than any other backup cutting element. As illustrated in FIG. 9, the backup cutting element 311 comprises a generally circular cross-sectional contour, the backup cutting element 312 comprises a rounded, trapezoidal cross-sectional contour, the backup cutting element 313 comprises a hemispherical cross-sectional contour, the backup cutting element 314 comprises a trapezoidal-like cross-sectional contour, and the backup cutting element 315 comprises an elliptical cross-sectional contour. The illustrated cross-sectional shapes are not limiting and other, different shapes can be employed.

It will further be appreciated that cutting elements within a set, that is cutting elements comprising the same radial position and circumferentially spaced apart along the drill bit body 326 may comprise the same cutting element shape (as viewed in cross-section). However, in other embodiments it may be suitable that cutting elements within a set comprise different cutting element shapes relative to each other.

Figure 10A:
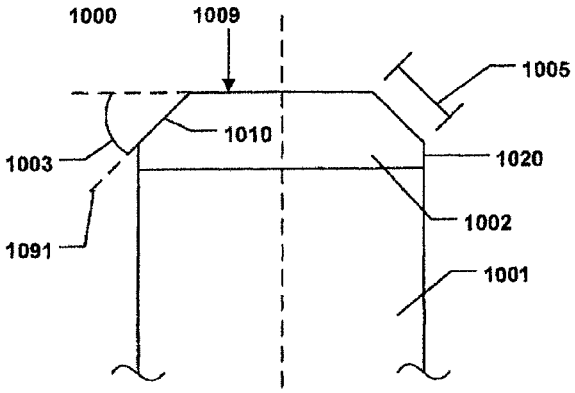
FIGS. 10A-10C include cross-sectional illustrations of cutting elements having various superabrasive table configurations including shift for angles in accordance with an embodiment.
Figure 10B:
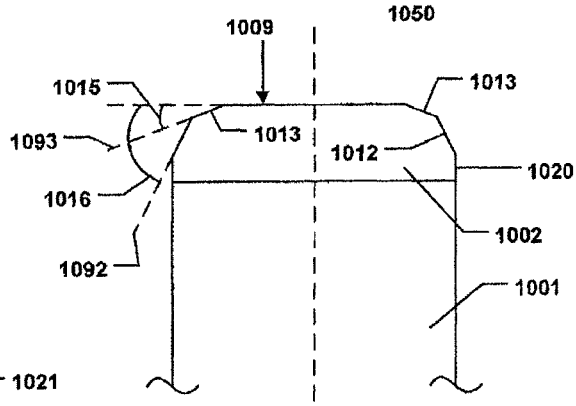
Figure 10C:
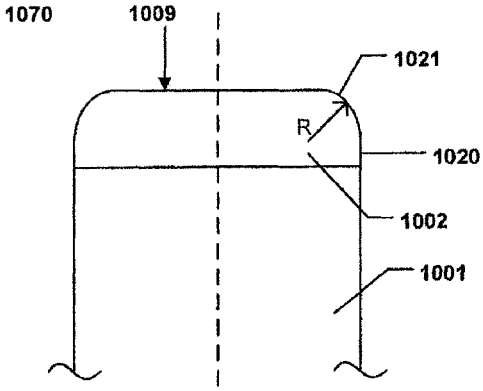

FIGS. 10A-10C include cross-sectional illustrations of backup cutting elements in accordance with embodiments herein. In particular FIGS. 10A-10C illustrate various designs of backup cutting element tables employing various chamfer angles, chamfer lengths, and radiused edges, which may be used in any of the backup cutting elements. FIG. 10A includes a cross-sectional illustration of a cutting element 1000 including a substrate 1001 and having a superabrasive layer 1002 overlying the substrate 1001. As illustrated, the superabrasive layer 1002 comprises a chamfered surface 1010 that defines a chamfer angle 1003 between a plane defined by the upper surface 1009 of the superabrasive layer 1002 and a plane 1091 defined by the chamfered surface 1010.

Notably, the chamfer angle 1003 can be modified depending upon the position of the backup cutting element along the drill bit body 326, and more particularly depending upon its position along a radial axis. According to one embodiment, any two backup cutting elements within the same group of backup cutting elements can comprise different chamfer angles relative to each other. For example, in certain designs, cutting elements closer to the center of the drill bit body 326 may comprise a smaller chamfer angle than a backup cutting element spaced at a greater distance from the center of the drill bit body 326 along the same radial axis.

In particular designs, the difference in the chamfer angle 1003 between two backup cutting elements within the same group can be at least about 2 degrees. In other embodiments, the difference in chamfer angle 1003 between two backup cutting elements within a group can be greater, such as at least about 5 degrees, at least about 10 degrees, at least about 20 degrees, at least about 30 degrees, at least about 40 degrees, at least about 60 degrees, or even at least about 80 degrees. In particular instances, the difference in chamfer angle 1003 between two backup cutting elements within a group is within a range between about 10 degrees and 80 degrees, such as between about 15 degrees and 75 degrees, between 20 degrees and 60 degrees, or even between about 20 degrees and about 55 degrees.

Additionally, the chamfered surface 1010 has a chamfer length 1005. The chamfer length 1005 is a measure of distance along the chamfer surface 1010 between the joint of the upper surface 1009 of the superabrasive layer 1002 and the chamfered surface 1010 and the joint of the side surface 1020 of the superabrasive layer 1002 and the chamfered surface 1010. Notably, any two (or more) backup cutting elements within the same group of backup cutting elements may comprise a difference in chamfer surface length 1005.

Some drill bit designs can utilize backup cutting elements within a group having a difference in the chamfer length of at least about 0.1 mm, such as at least about 0.25 mm, at least about 0.5 mm, at least about 0.75 mm, or even at least about 1 mm. Particular embodiments can employ a difference in chamfer length between backup cutting elements of a group within a range between 0.1 mm and about 1 mm, such as between about 0.1 mm and 0.75 mm, or even between about 0.1 mm and about 0.5 mm.

FIG. 10B includes a cross-sectional illustration of an alternative backup cutting element in accordance with an embodiment. As illustrated, a backup cutting element 1050 has those portions previously described herein, particularly including a substrate 1001 and a superabrasive layer 1002 overlying the substrate 1001. The backup cutting element 1050 includes two chamfered surfaces, a first chamfered surface 1012 and a second chamfered surface 1013, each of which extend between the upper surface 1009 and a side surface 1020 of the superabrasive layer 1002 and are connected to each other. The chamfered surface 1012 can have a chamfer angle 1016 defined between the plane of the upper surface 1009 of the superabrasive layer 1002 and a plane 1092 defining the chamfered surface 1012. The chamfered surface 1013 can also define a chamfer angle 1015 between the plane of the upper surface 1009 of the superabrasive layer 1002 and a plane 1093 defining the chamfered surface 1013 as it extends relative to the plane of the upper surface 1009. According to particular embodiments, the chamfer angles 1015 and 1016 between any two backup cutting elements within the same group can be different.

As will be appreciated, the chamfer length of any of the chamfered surfaces 1012 and 1013 may be modified, and more particularly the length of the chamfered surfaces 1012 and 1013 between any two backup cutting elements within the same group can be different. According to designs of drill bits herein, a backup cutting element within a group can comprise a different chamfer angle, number of chamfered surfaces, and/or chamfer length, than any other backup cutting element in the same group.

FIG. 10C includes an illustration of another backup cutting element 1070 in accordance with an embodiment. Notably, the backup cutting element 1070 includes those elements previously described herein in accordance with FIGS. 10A and 10B. However, the backup cutting element 1070 comprises a radiused edge 1021 between a side surface 1020 and upper surface 1009 of the superabrasive layer 1002. The radiused edge 1021 may have a particular curvature, defined by the radius (R), suitable for cutting applications. As will be appreciated, any one of the backup cutting elements within a group may utilize the radiused edge 1021 that can be different than another radiused edge of another backup cutting element within the same group. That is, in particular, the radius of curvature may be different between any two backup cutting elements within the same group.

While reference has been made herein to utilizing different chamfer angles, number of chamfers, chamfer lengths, and radiused edges among different backup cutting elements within the same group, it will be further appreciated that backup cutting elements within a group may differ from each other based upon cutting element material. For example, two backup cutting elements within the same group may utilize superabrasive tables made of a different material (material having a difference in composition) or material having a different grade. Differences in superabrasive table can vary based upon the type of feedstock material used to form the superabrasive table. The feedstock material can vary based on the size of superabrasive grit material used, the quality of superabrasive material used, and distribution of sizes of superabrasive material used to form the superabrasive table. As such, the final mechanical properties of the material within the superabrasive table can vary, such that certain backup cutting elements within a group can have different mechanical characteristics as compared to another backup cutting element within the same group. For example, certain drill bits can be formed that use backup cutting elements within the same group that are positioned based upon intended application and mechanical performance. That is, one backup cutting element can have greater wear resistance or toughness as compared to another backup cutting element that has greater abrasion resistance. Such differences can be based upon the difference in material, difference in grade, or a combination thereof.

Additionally, the overall composition of the superabrasive table between any two backup cutting elements within the same group can be different. For example, certain different types of materials can include oxides, carbide, borides, nitrides, and carbon-based materials. In more particular instances, two backup cutting elements may employ a polycrystalline diamond compact (PDC) layer, but the presence of a catalyst material may differ between the two backup cutting elements, such that one uses a standard PDC layer and the other backup cutting element within the same group utilizes a TSP (thermally stable polycrystalline-diamond) material.

Figure 11:
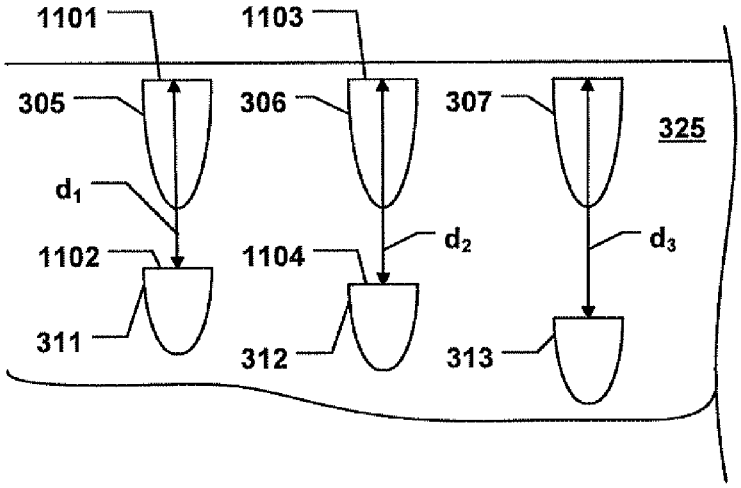
FIG. 11 includes a top view illustration of a portion of a blade including primary cutting elements and backup cutting elements having various circumferential offsets in accordance with an embodiment.

FIG. 11 includes a top view of a portion of a blade comprising primary cutting elements and corresponding backup cutting elements in accordance with an embodiment. As illustrated, the blade 325 comprises the primary cutting elements 305, 306, and 307 and corresponding backup cutting elements 311, 312, and 313, respectively. As further illustrated, and in accordance with embodiments herein, the backup cutting elements 311-313 may be situated in circumferential relationship to their corresponding primary cutting elements 305-307 such that the distance between cutting faces (circumferential offset) is different. For example, the primary cutting element 305 can have an upper face 1101, which is circumferentially spaced apart from a front surface 1102 of the backup cutting element 311 by a distance $d_1$. Likewise, the primary cutting element 306 has a front face 1103 that is spaced apart from a front face 1104 of its corresponding backup cutting element 312 by a distance $d_2$. Notably, in accordance with an embodiment, the distances $d_1$ and $d_2$ (circumferential offsets) can be different between backup cutting elements 311 and 312 and their corresponding primary cutting elements 305 and 306, respectively. Controlling the circumferential offset between backup cutting elements and their corresponding primary cutting elements may facilitate control of timing at which the backup cutting elements initiate cutting and aid material removal in the well bore.

According to some embodiments herein, backup cutting elements within a group can have a difference in the circumferential offset of at least about 1 mm. In other instances, the difference in circumferential offset between two backup cutting elements within the group can be greater, such as at least about 5 mm, at least about 10 mm, at least about 20 mm, at least about 30 mm, or even at least about 40 mm. Particular designs may incorporate a difference in the circumferential offset between two backup cutting elements within a range of about 1 mm and about 55 mm, such as within a range between about 1 mm and about 50 mm, or more particularly within a range between about 1 mm and about 40 mm.

As will be further appreciated, backup cutting elements within a set may comprise the same circumferential offset with respect to their corresponding primary cutting elements. However, in other embodiments, a difference in the circumferential offset between two backup cutting elements and their corresponding primary cutting elements within the same set may be utilized.

EXAMPLE 1

A drill bit was formed having the shape and arrangement of blades as shown in FIG. 3. The drill bit body was formed primarily of cemented tungsten carbide and the cutting elements were formed of PDC cutting elements. The drill bit was a Quantec Q508HX model drill bit of 8⅜ inch dimension, available from Baker Hughes. Through the use of empirical data, the drill bit was designed such that the cutting characteristics of the backup cutting elements within the drill bit body were modified based upon known criteria, such as the expected rock formations through which the drill bit was expected to penetrate. The following exemplary drill bit was designed to penetrate hard and superhard rock formations.

Figure 12A:
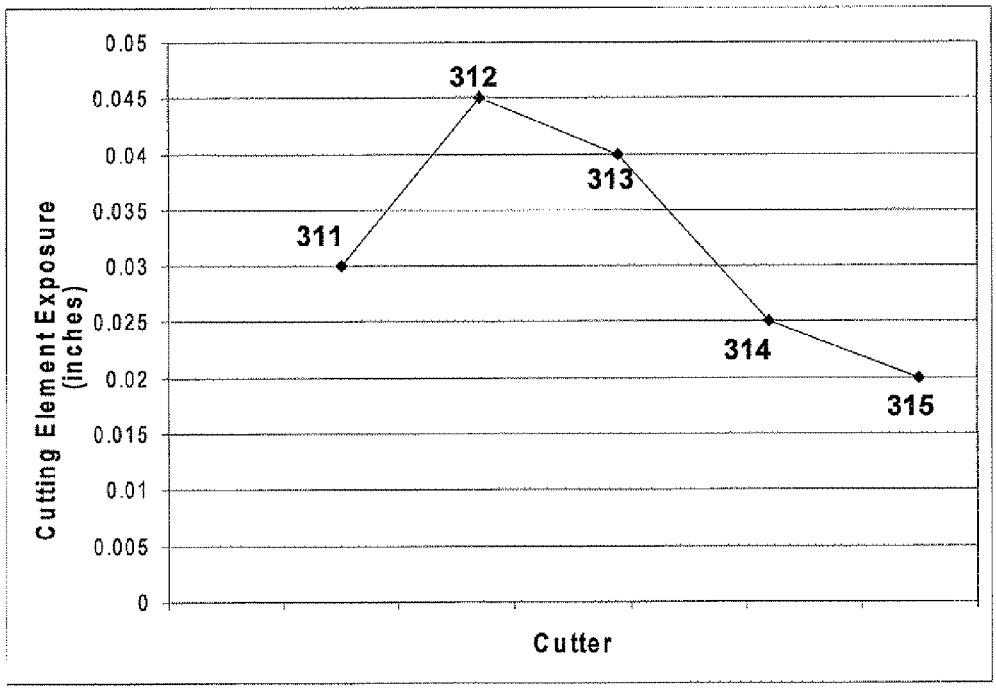
FIGS. 12A-12D include plots of cutting element exposure for each of the backup cutting elements of the drill bit of Example 1.
Figure 12B:
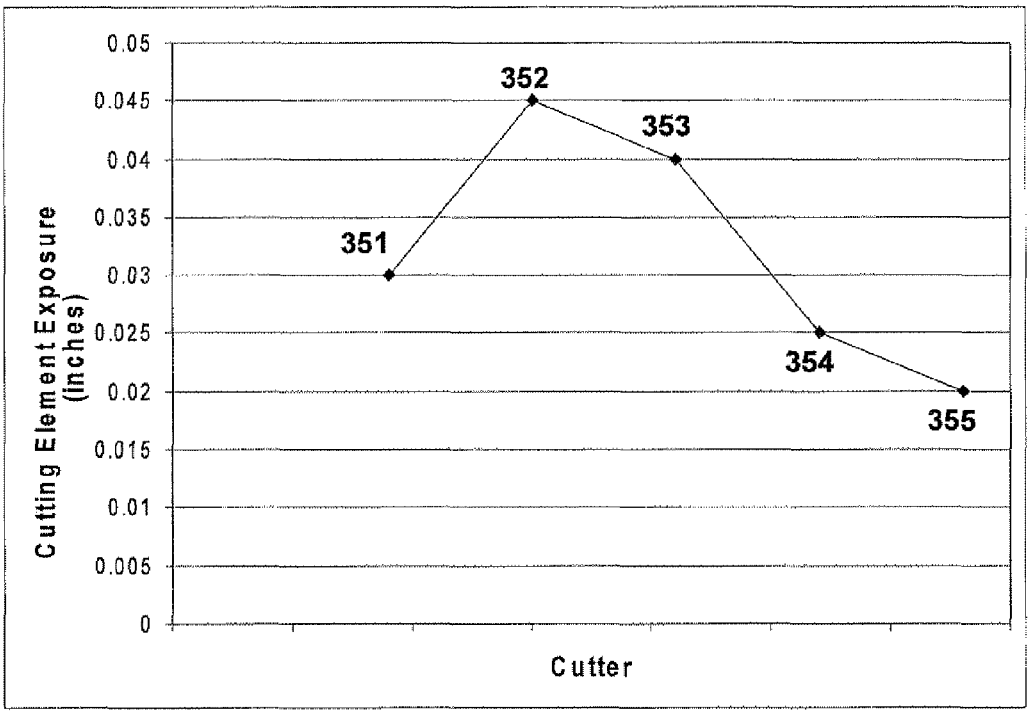
Figure 12C:
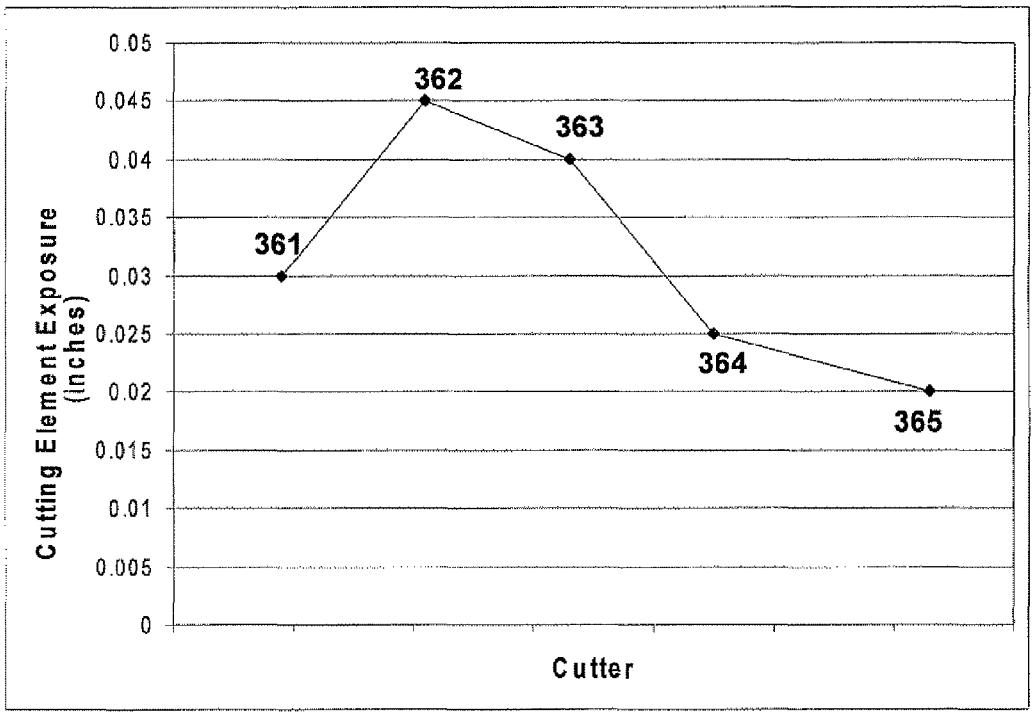
Figure 12D:
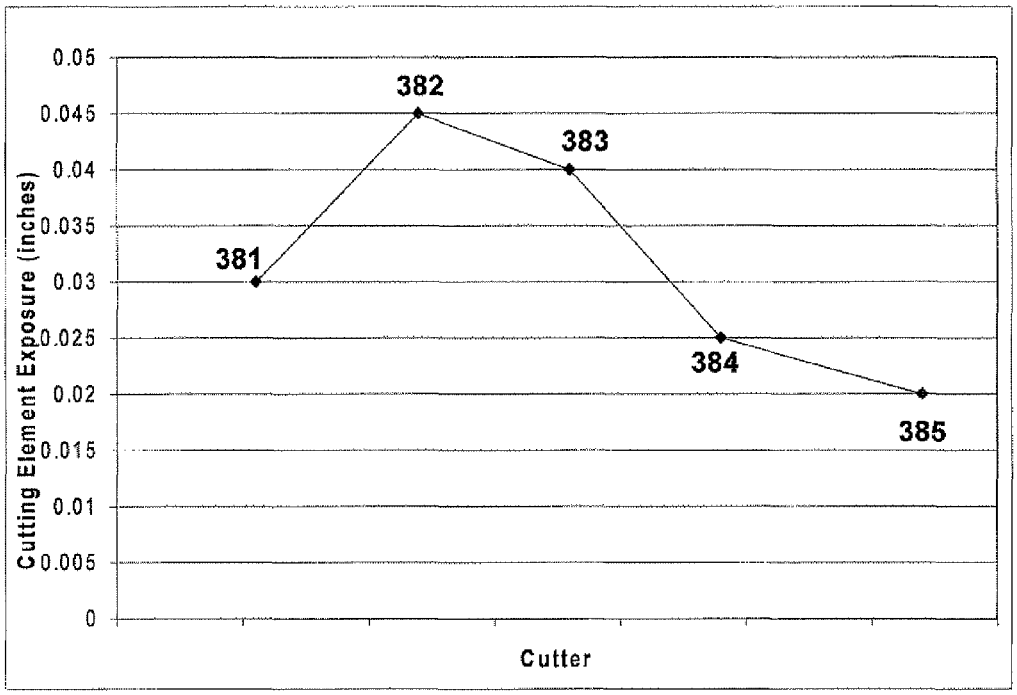

First, the cutting element exposure for each of the backup cutting elements on each of the blades 325, 340, 370, and 390 was adjusted as provided in FIGS. 12A-12D. That is, as illustrated in FIG. 12A, the cutting element exposure of the backup cutting elements within the same group were different compared to each other. In particular, the backup cutting element 311 on blade 325 was set to be 0.03 inch (or approximately 0.76 mm), the backup cutting element 312 had a cutting element exposure of 0.045 inch, the backup cutting element 313 had a cutting element exposure of 0.04 inch, the backup cutting element 314 had a cutting element exposure of 0.025 inch, and the backup cutting element 315 had a cutting element exposure of 0.02 inch. The cutting element exposures for all of the backup cutting elements for each of the blades 325, 340, 370, and 390 were modified. Notably, as illustrated in FIGS. 12A-12D, the cutting element exposure of cutting elements with the same set (e.g., cutting elements 311, 351, 361, and 381) were the same.

Figure 13A:
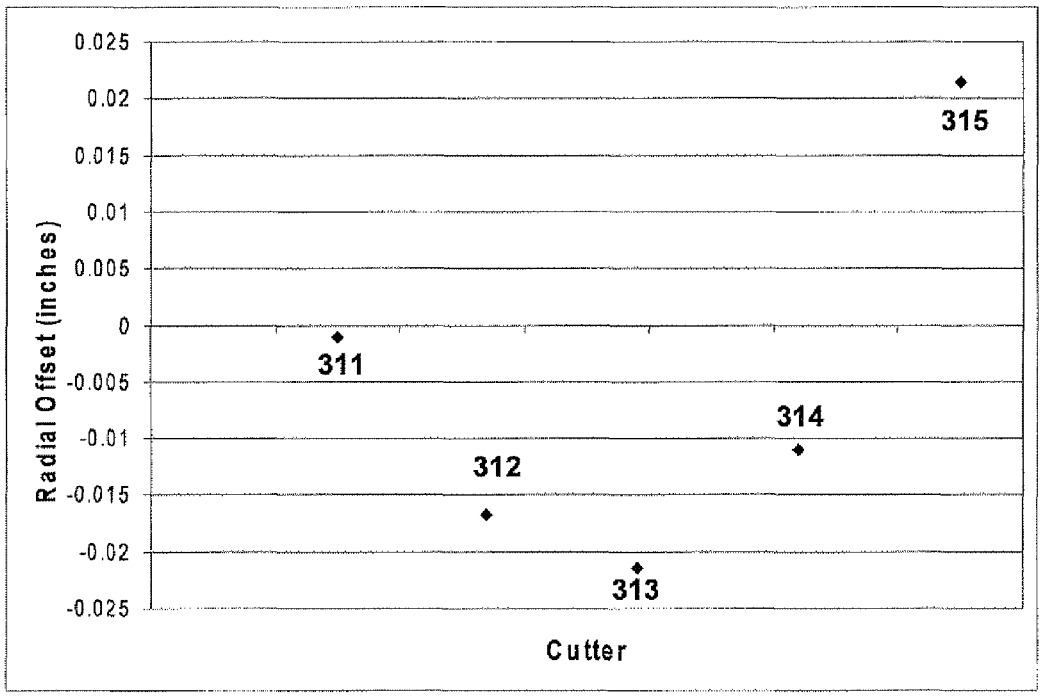
FIGS. 13A-13D include plots of radial offset for each of the backup cutting elements of the drill bit of Example 1.
Figure 13B:
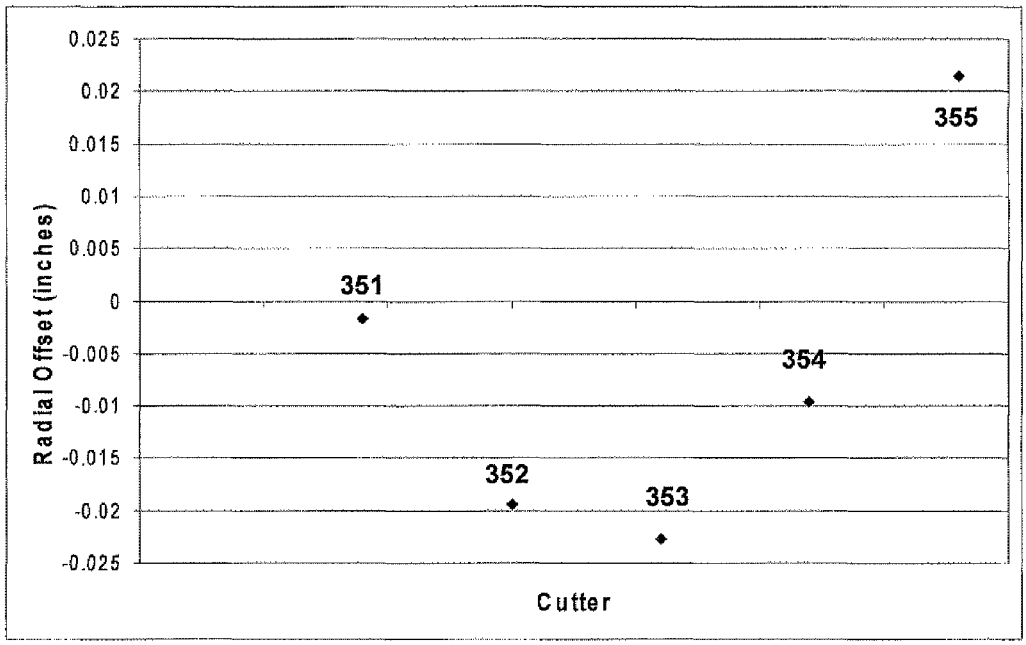
Figure 13C:
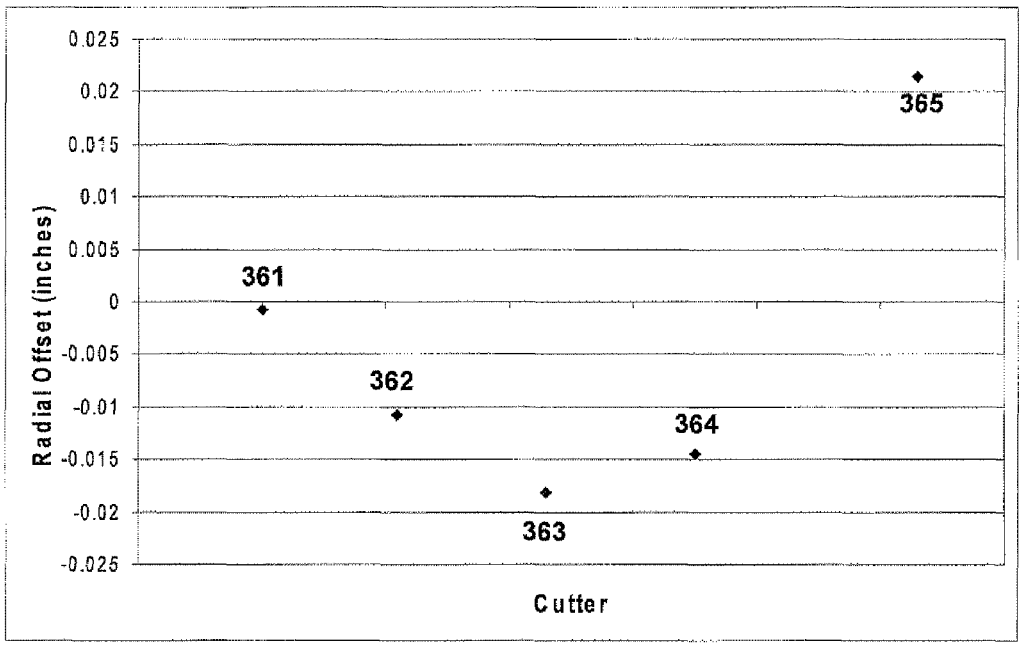
Figure 13D:
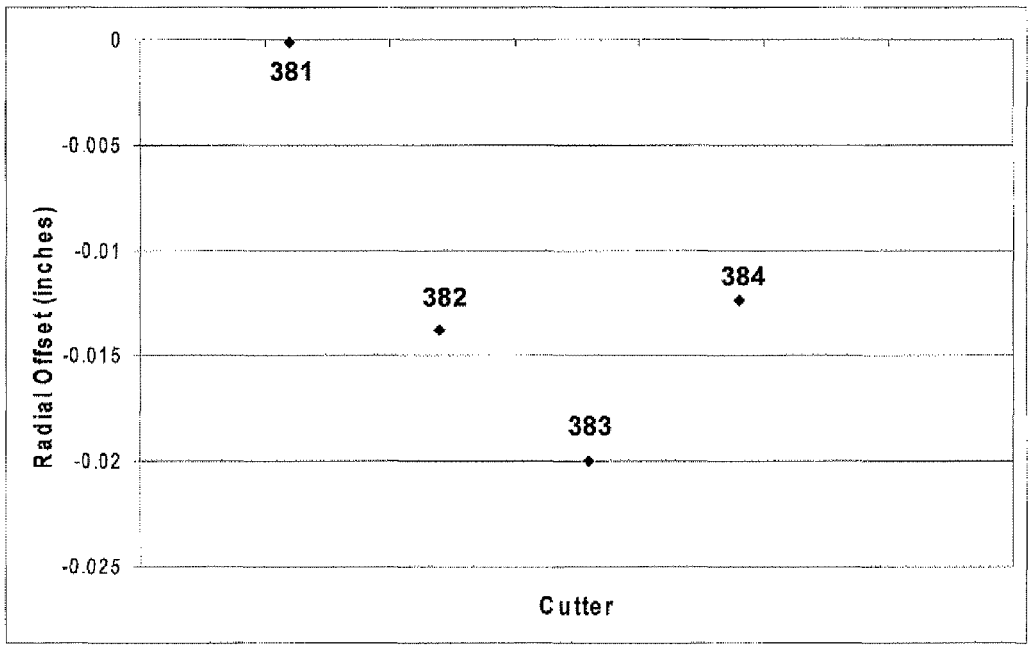
Figure 14A:
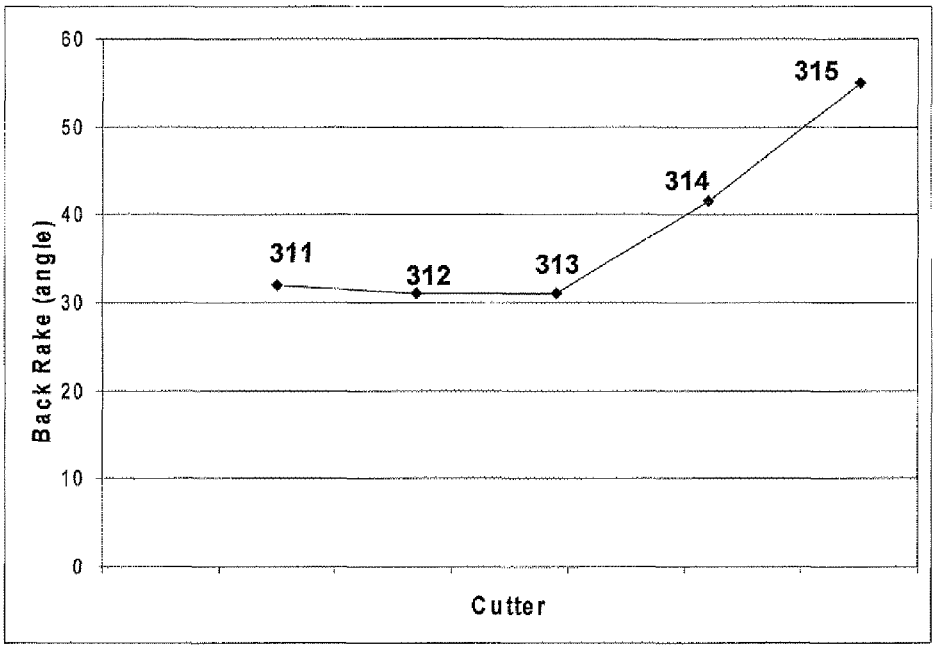
FIGS. 14A-14D include plots of backrake angle for each of the backup cutting elements of the drill bit of Example 1.
Figure 14B:
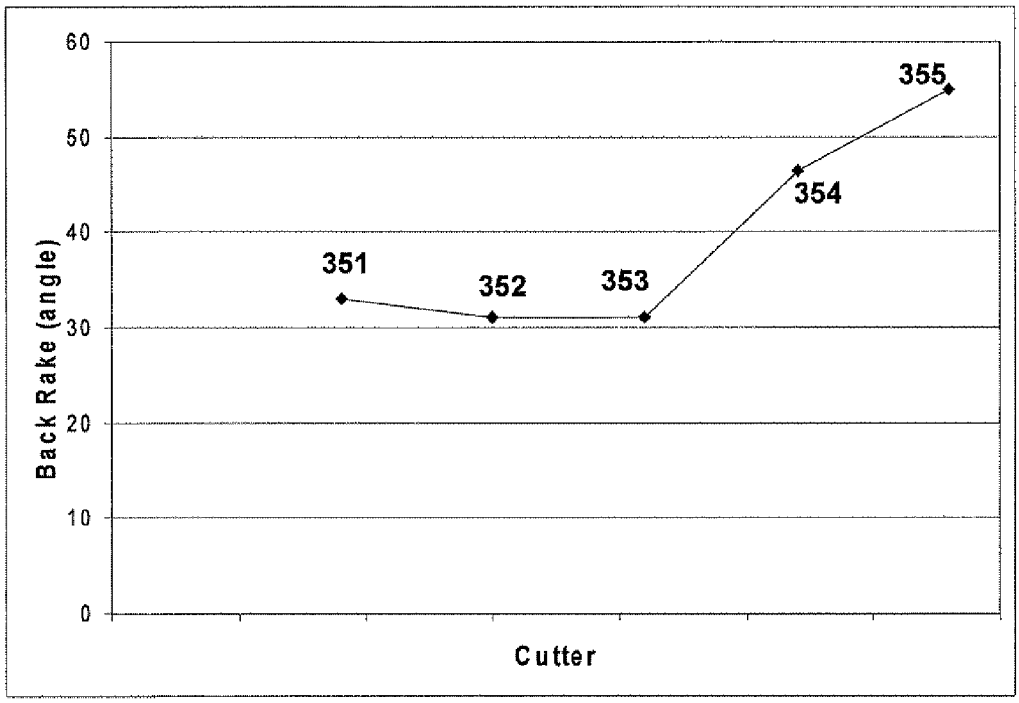
Figure 14C:
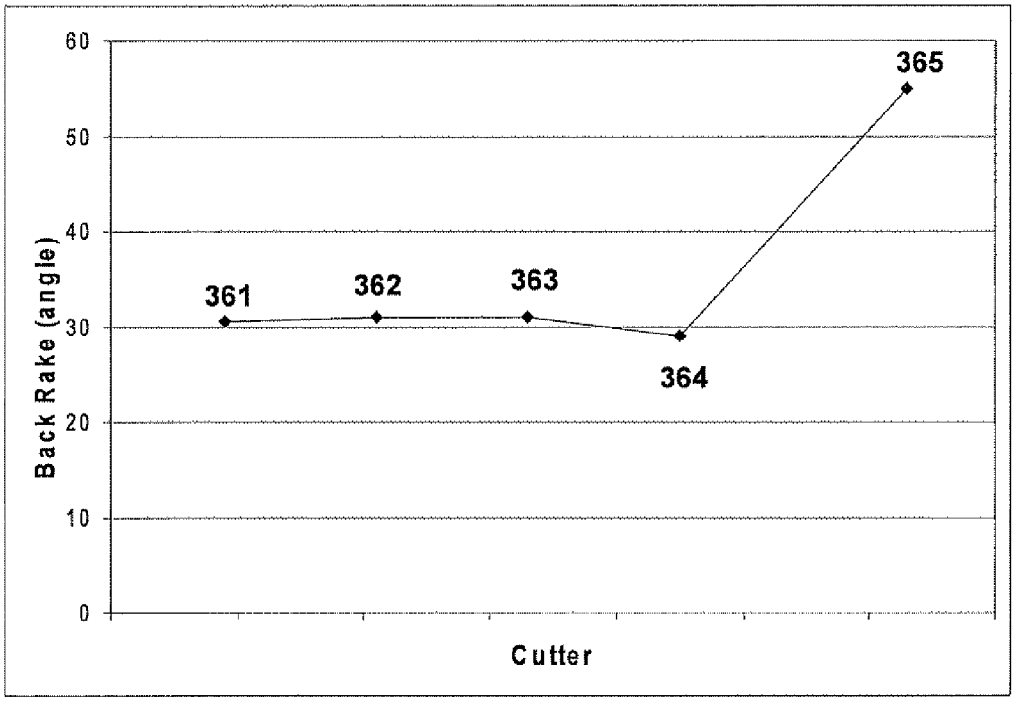
Figure 14D:
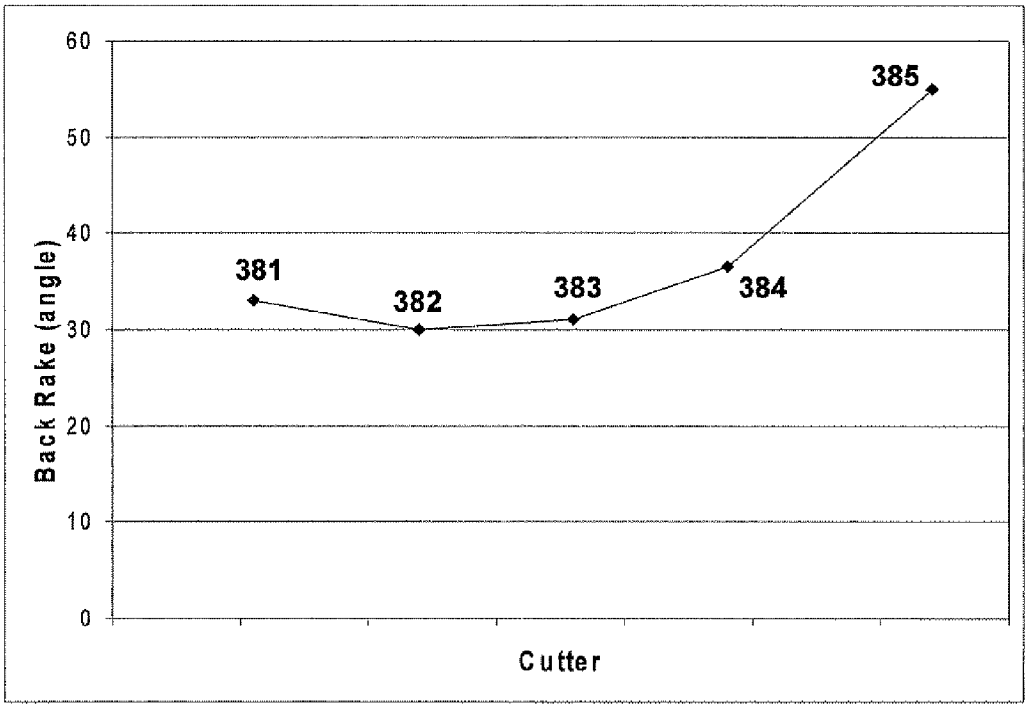

After adjusting the cutting element exposure for the backup cutting elements based on empirical data generated from expected operating conditions, the radial offset cutting characteristic for each of the backup cutting elements on each of the blades 325, 340, 370, and 390 was modified. The radial offset for each of the backup cutting elements is provided in FIGS. 13A-13D. As illustrated in FIG. 13A, the radial offset of the backup cutting element 311 was approximately—0.001 inch (—0.025 mm), the radial offset of the backup cutting element 312 was approximately—0.017 inch, the radial offset of the backup cutting element 313 was approximately—0.022 inch, the radial offset of the backup cutting element 314 was approximately—0.011 inch, and the radial offset of the backup cutting element 315 was approximately 0.022 inch. Notably, the negative radial offset indicates a radial shift inward, that is, toward the center of the drill bit body as compared to the position of the corresponding primary cutting element, while a positive radial offset indicates a radial shift outward, that is, away from the center of the drill bit body as compared to the position of the corresponding primary cutting element.

Notably, the radial offset of the backup cutting elements within the same sets is not necessarily the same. For instance, in a comparison between the radial offset of the backup cutting elements 312, 352, 362, and 382 in FIGS. 13A-13D, the radial offset is different between each of the backup cutting elements within the set.

After modifying the radial offset of the cutting elements within the same group (and the same set for some backup cutting elements), the backrake angle for each of the backup cutting elements on each of the blades 325, 340, 370, and 390 was adjusted as provided in FIGS. 14A-14D. As demonstrated in FIG. 14A, the backrake angle for the backup cutting element 311 was approximately 32 degrees, the backrake angle for the backup cutting element 313 was approximately 31 degrees, the backrake angle for the backup cutting element 314 was approximately 41 degrees, and the backrake angle for the backup cutting element 315 was approximately 55 degrees. Each of the backrake angles are positive backrake angles.

Moreover, as illustrated in a comparison of FIGS. 14A-14D, the backrake angles for the backup cutting elements within a set were different. For instance, the backrake angle for the backup cutting element 311 was approximately 32 degrees, the backrake angle for the backup cutting element 351 was approximately 34 degrees, the backrake angle for the backup cutting element 361 was approximately 31 degrees, and the backrake angle for the backup cutting element 381 was approximately 34 degrees.

This drill bit was then performance tested in rock formations conventionally thought of in the industry as too hard for fixed-cutter drill bits. The formations drilled included abrasive sandstone, hard sandy shales, and hard shaly sandstones in Kauther-20 well in Kauther drilling Field, Oman. The bit started drilling at 2864 m and drilled to a depth of 3357 m, penetrating 493 meters of earth formations at an average rate of penetration of 4.76 meters/hour.

It is established that the length of time that a drill bit may be employed before the drill string must be tripped and the bit changed depends upon the bit's rate of penetration ("ROP"), as well as its durability, that is, its ability to maintain a suitable ROP. In recent years, PDC bits have been regularly used for penetrating formations of soft and medium hardness. Notably, however, such drill bits have not been employed in hard and superhard formations, since conventional wisdom dictates that such bits are not capable of achieving suitable rates of penetration over such distances in these formations.

The drill bits of the embodiments herein represent a departure from the state-of-the-art and include a combination of features making the drill bits capable of improved performance, even to the extent of achieving rates of penetration in rock formations previously never drill by fixed-cutter drill bits. The combination of features include use of backup cutting elements having cutting characteristics that are capable of being different between other backup cutting elements within the same group and even within the same set. The approach to using backup cutting elements within the art has been that such cutters are to be used as redundant support mechanisms for primary cutting elements intended to conduct the majority of shearing and cutting during operation. The drill bits of the presently disclosed embodiments demonstrate that cutting characteristics of backup cutting elements can play a significant role in the performance of the drill bit, and particularly that fine control of these cutting characteristics and variation of the cutting characteristics for backup cutting elements within the same group can result in unexpected and vastly improved performance.

The above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing.

The Abstract of the Disclosure is provided to comply with Patent Law and is submitted with the understanding that it will not be used to interpret or limit the scope or meaning of the claims. In addition, in the foregoing Brief Description of the Drawings, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments. Thus, the following claims are incorporated into the Brief Description of the Drawings, with each claim standing on its own as defining separately claimed subject matter.

What is claimed is:

1. A drill bit for drilling subterranean formations comprising:

a drill bit body comprising:

a group of primary cutting elements on a first blade, the group of primary cutting elements comprising a first primary cutting element and a second primary cutting element radially spaced apart from each other along a first radial axis; and a group of backup cutting elements on the first blade, the group of backup cutting elements comprising a first backup cutting element in a secondary cutting position relative to the first primary cutting element and a second backup cutting element in secondary cutting positions relative to the second primary cutting element, wherein the first backup cutting element and the second backup cutting element are radially spaced apart from each other along a second radial axis different than the first radial axis and comprise a difference in cutting characteristic relative to each other of one of a backrake angle and a siderake angle, and wherein at least one of the first backup cutting element and the second backup cutting element is overexposed relative to at least one of the first primary cutting element and the second primary cutting element, wherein the exposures of the backup cutting elements of the group of backup cutting elements decrease with increasing distance from a center of the drill bit body along the second radial axis, and wherein one of the backrake angles and siderake angles of the backup cutting elements of the group of backup cutting elements increase with increasing distance from the center of the drill bit body along the second radial axis.

2. The drill bit of claim 1, wherein the first and second backup cutting elements comprise a difference in backrake angle relative to each other of at least about 5°.

3. The drill bit of claim 2, wherein the first and second backup cutting elements comprise a difference in backrake angle relative to each other within a range between about 2° and about 60°.

4. The drill bit of claim 1, wherein the first and second backup cutting elements comprise a difference in siderake angle relative to each other of at least about 5°.

5. The drill bit of claim 1, further comprising at least one additional backup cutting element positioned along a third radial axis different than the first radial axis and the second radial axis, wherein the drill bit comprises a set of backup cutting elements comprising the first backup cutting element and the at least one additional backup cutting element having the same radial position on the drill bit body and spaced apart from each other through a portion of a circumference extending around a center of the drill bit body.

6. The drill bit of claim 5, wherein the first and the at least one additional backup cutting elements comprise a different backrake angle relative to each other.

7. The drill bit of claim 5, wherein the first and the at least one additional backup cutting elements comprise a different siderake angle relative to each other.

8. The drill bit of claim 5, wherein the first and the at least one additional backup cutting elements comprise a same cutting element exposure relative to each other as measured from their respective primary cutting elements.

9. The drill bit of claim 1, wherein the first and second backup cutting elements comprise a difference in backrake angle and siderake angle relative to each other.

10. The drill bit of claim 1, wherein the first and second backup cutting elements further comprise a difference in cutting characteristic relative to each other selected from the group of cutting characteristics consisting of cutting element size, cutting element shape, cutting element exposure, siderake angle, backrake angle, chamfer length, chamfer angle, radial offset, circumferential offset, cutting element material, and a combination thereof.

11. The drill bit of claim 10, wherein the first backup cutting element comprises a first cutting element exposure relative to the corresponding primary cutting element and the second backup cutting element comprises a second cutting element exposure relative to the corresponding second primary cutting element, and wherein the first cutting element exposure is different than the second cutting element exposure.

12. The drill bit of claim 11, wherein the first cutting element exposure and the second cutting element exposure are different from each other by at least about 5% based on the cutting element exposure having the greater value.

13. The drill bit of claim 11, wherein the first cutting element exposure is different than the second cutting element exposure by an amount within a range between about 0.1 mm and about 10 mm.

14. The drill bit of claim 1, wherein the first radial axis and the second radial axis are separated by a radial angle of not greater than about 45°.

15. A drill bit for drilling subterranean formations comprising:

a drill bit body comprising:

a group of primary cutting elements on a first blade; and a group of backup cutting elements on the first blade, each of the backup cutting elements having a lower exposure than a corresponding one of the primary cutting elements, the group of backup cutting elements comprising a first backup cutting element and a second backup cutting element radially spaced apart from each other and different from each other in at least one cutting characteristic selected from the group of cutting characteristics consisting of cutting element shape, chamfer angle, number of chamfers, and radius of curvature of a radiused edge between a side surface and an upper surface of the cutting element, wherein the exposures of the backup cutting elements of the group of backup cutting elements decrease with increasing distance from a center of the drill bit body, and wherein one of backrake angles and siderake angles of the backup cutting elements of the group of backup cutting elements increase with increasing distance from a center of the drill bit body along a radial axis.

16. The drill bit of claim 15, wherein the first and second backup cutting elements comprise at least two different cutting characteristics.

17. The drill bit of claim 15, wherein the first and second backup cutting elements further comprise a difference in cutting element exposure and backrake angle.

18. The drill bit of claim 15, wherein the first and second backup cutting elements further comprise a difference in cutting element exposure and siderake angle.

19. The drill bit of claim 15, wherein the first and second backup cutting elements further comprise a difference in cutting element exposure and radial offset.

20. A drill bit for drilling subterranean formations comprising:

a drill bit body comprising:

a group of primary cutting elements comprising a first primary cutting element and a second primary cutting element radially spaced apart from each other along a first radial axis;

a group of backup cutting elements comprising a first backup cutting element in a secondary cutting position relative to the first primary cutting element and a second backup cutting element in secondary cutting positions relative to the second primary cutting element, wherein the first and second backup cutting elements are radially spaced apart from each other along a second radial axis different than the first radial axis and comprise a difference in cutting characteristic relative to each other of one of a backrake angle and a siderake angle, wherein the one of backrake angles and siderake angles of the backup cutting elements of the group of backup cutting elements increase with increasing distance from a center of the drill bit body along the second radial axis; and at least one additional backup cutting element positioned along a third radial axis different than the first radial axis and the second radial axis, wherein the drill bit comprises a set of backup cutting elements comprising the first backup cutting element and the at least one additional backup cutting element having the same radial position on the drill bit body and spaced apart from each other through a portion of a circumference extending around a center of the drill bit body; and wherein at least one of the first backup cutting element, the second backup cutting element, and the at least one additional backup cutting element is over-exposed relative to at least one of the first primary cutting element and the second primary cutting element.

* * * * *

UNITED STATES PATENT AND TRADEMARK OFFICE

CERTIFICATE OF CORRECTION

PATENT NO. : 8,887,839 B2
APPLICATION NO. : 12/817411
DATED : November 18, 2014
INVENTOR(S) : Chaitanya K. Vempati et al.

It is certified that error appears in the above-identified patent and that said Letters Patent is hereby corrected as shown below:

On the title page:

In ITEM (75) Inventors:

PAGE 1, COLUMN 1, LINE 3, change "Edwin R Reek," to --Edwin E. Reek,--

In the specification:

COLUMN 5, LINE 1, change "backup" to --group of backup--
COLUMN 7, LINE 16, change "that is approximately 90 degrees to relative" to --that is, approximately 90 degrees relative--
COLUMN 7, LINE 23, change "group of the backup" to --group of backup--
COLUMN 12, LINE 55, change "bit Body" to --bit body--

Signed and Sealed this
Fifteenth Day of December, 2015

Michelle K. Lee

Michelle K. Lee
*Director of the United States Patent and Trademark Office*